US011976891B2

(12) United States Patent
Wang et al.

(10) Patent No.: US 11,976,891 B2
(45) Date of Patent: May 7, 2024

(54) HEAT TRANSFER ENHANCEMENT PIPE AS WELL AS CRACKING FURNACE AND ATMOSPHERIC AND VACUUM HEATING FURNACE INCLUDING THE SAME

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

(72) Inventors: Guoqing Wang, Beijing (CN); Junjie Liu, Beijing (CN); Lijun Zhang, Beijing (CN); Cong Zhou, Beijing (CN); Zhaobin Zhang, Beijing (CN); Shasha Yang, Beijing (CN); Dongfa Shen, Beijing (CN); Xiaofeng Li, Beijing (CN); Shifang Yang, Beijing (CN); Zhiguo Du, Beijing (CN); Yonggang Zhang, Beijing (CN); Ying Shi, Beijing (CN); Jinghang Guo, Beijing (CN)

(73) Assignees: China Petroleum & Chemical Corporation, Beijing (CN); Beijing Research Institute of Chemical Industry, China Petroleum & Chemical Corporation, Beijing (CN)

( * ) Notice: Subject to any disclaimer, the term of this patent is extended or adjusted under 35 U.S.C. 154(b) by 97 days.

(21) Appl. No.: 16/758,155

(22) PCT Filed: Oct. 25, 2018

(86) PCT No.: PCT/CN2018/111797
§ 371 (c)(1),
(2) Date: Apr. 22, 2020

(87) PCT Pub. No.: WO2019/080886
PCT Pub. Date: May 2, 2019

(65) Prior Publication Data

US 2020/0326141 A1 Oct. 15, 2020

(30) Foreign Application Priority Data

Oct. 27, 2017 (CN) ..... 201711023424.X
Oct. 27, 2017 (CN) ..... 201711027588.X
(Continued)

(51) Int. Cl.
*F28F 1/40* (2006.01)
*C10G 9/20* (2006.01)
(Continued)

(52) U.S. Cl.
CPC ..... *F28F 1/40* (2013.01); *C10G 9/20* (2013.01); *F28F 1/006* (2013.01); *F28F 1/10* (2013.01);
(Continued)

(58) Field of Classification Search
CPC .... F28F 1/40; F28F 1/405; F28F 13/02; F28F 13/12; F28F 13/125; F28F 2270/00;
(Continued)

(56) References Cited

U.S. PATENT DOCUMENTS 4,368,777 A * 1/1983 Grasso ..... F28D 7/106 165/146
4,937,064 A * 6/1990 Gonzalez ..... F28F 1/40 165/179
(Continued)

FOREIGN PATENT DOCUMENTS

CN 1711340 A 12/2005
CN 202126200 U 1/2012
(Continued)

OTHER PUBLICATIONS

Extended European search report for EP18870014.0, dated Oct. 21, 2021.
(Continued)

*Primary Examiner* — Tho V Duong
(74) *Attorney, Agent, or Firm* — Finnegan, Henderson, Farabow, Garrett & Dunner LLP

(57) ABSTRACT

The present invention relates to the field of fluid heat transfer, and discloses a heat transfer enhancement pipe as
(Continued)

well as a cracking furnace and an atmospheric and vacuum heating furnace including the same. The heat transfer enhancement pipe (1) includes a pipe body (10) of tubular shape having an inlet (100) for entering of a fluid and an outlet (101) for said fluid to flow out; internal wall of the pipe body (10) is provided with a fin (11) protruding towards interior of the pipe body (10), the fin (11) spirally extends in an axial direction of the pipe body (10), wherein a height of the fin (11) gradually increases from one end in at least a part extension of the fin. The heat transfer enhancement pipe can reduce thermal stress of itself, thereby increasing service life of the heat transfer enhancement pipe.

20 Claims, 28 Drawing Sheets

(30) Foreign Application Priority Data

Oct. 27, 2017 (CN) ..... 201711029500.8
Oct. 27, 2017 (CN) ..... 201711056794.3
Oct. 27, 2017 (CN) ..... 201711057043.3

(51) Int. Cl.
*F28F 1/00* (2006.01)
*F28F 1/10* (2006.01)
*F28F 13/08* (2006.01)
*F28F 13/12* (2006.01)
*F28D 21/00* (2006.01)

(52) U.S. Cl.
CPC ..... *F28F 13/08* (2013.01); *F28F 13/12* (2013.01); *F28D 2021/0024* (2013.01); *F28D 2021/0056* (2013.01); *F28D 2021/0075* (2013.01); *F28F 2270/00* (2013.01)

(58) Field of Classification Search
CPC ..... F28F 13/06; F28D 2021/0024; F28D 2021/0056; F28D 2021/0075; F22B 37/06
See application file for complete search history.

(56) References Cited

U.S. PATENT DOCUMENTS

| | | | | |
|---|---|---|---|---|
| 5,579,831 | A | 12/1996 | Brucher | |
| 5,605,400 | A * | 2/1997 | Kojima | B01D 53/504 366/339 |
| 5,950,718 | A * | 9/1999 | Sugitani | F28F 1/40 165/184 |
| 6,000,466 | A | 12/1999 | Aoyagi et al. | |
| 6,026,892 | A | 2/2000 | Kim et al. | |
| 6,210,747 | B1 | 4/2001 | Trotter, Jr. | |
| 7,185,698 | B1 | 3/2007 | Bernert, Jr. et al. | |
| 7,532,468 | B2 * | 5/2009 | Sun | H01L 23/467 165/185 |
| 8,784,047 | B2 * | 7/2014 | Elder | F04D 29/584 415/178 |
| 8,992,852 | B2 | 3/2015 | His et al. | |
| 9,873,305 | B2 * | 1/2018 | Bank | F24H 7/0233 |
| 2002/0070011 | A1 | 6/2002 | Itoh et al. | |
| 2006/0102327 | A1 * | 5/2006 | Inui | F28F 1/40 165/184 |
| 2007/0023164 | A1 | 2/2007 | Kidwell et al. | |
| 2009/0180935 | A1 | 7/2009 | Higuchi et al. | |
| 2010/0129269 | A1 | 5/2010 | Meissner et al. | |
| 2010/0143206 | A1 | 6/2010 | Hashimoto | |
| 2010/0307729 | A1 * | 12/2010 | Sarkisian | F28F 1/40 165/183 |
| 2012/0060727 | A1 | 3/2012 | Viennet et al. | |
| 2015/0114609 | A1 * | 4/2015 | Wang | F28F 1/12 165/109.1 |
| 2015/0300746 | A1 | 10/2015 | Takinami et al. | |

FOREIGN PATENT DOCUMENTS

| | | | |
|---|---|---|---|
| CN | 203443422 | U | 2/2014 |
| CN | 203881179 | U | 10/2014 |
| CN | 104560111 | A | 4/2015 |
| CN | 104833242 | A | 8/2015 |
| CN | 105664749 | A | 6/2016 |
| CN | 106959032 | A | 7/2017 |
| EP | 1561795 | A1 | 8/2005 |
| GB | 745 122 | A | 2/1956 |
| GB | 1 564 821 | A | 4/1980 |
| GB | 2519606 | A | 4/2015 |
| JP | 60-99998 | | 6/1985 |
| JP | 09072683 | | 3/1997 |
| JP | 2001041672 | A | 2/2001 |
| JP | 2013-112832 | | 6/2013 |
| KR | 20-1998-0058637 | U | 10/1998 |
| KR | 101000021 | B1 | 12/2010 |
| KR | 10-2011-0022710 | A | 3/2011 |
| KR | 10-2014-0056079 | A | 5/2014 |
| KR | 10-2016-0038418 | A | 4/2016 |
| SU | 1451533 | A2 | 1/1989 |
| WO | WO 2015/099009 | A1 | 7/2015 |

OTHER PUBLICATIONS

Extended European search report for EP18871432.3, dated Oct. 21, 2021.
Supplemental Partial European Search Report for European Patent Application No. 18871432.3, dated Jun. 17, 2021 (12 pages).
Supplemental Partial European Search Report for European Patent Application No. 18870014.0, dated Jun. 14, 2021 (12 pages).
Supplemental European Search Report for European Patent Application No. 18870774.9, dated Jun. 18, 2021 (7 pages).
Second Office Action dated Feb. 5, 2021, issued in Russian Patent Application No. 2020115117 (4 pages).
Goransky, G.K. et al., *Elements of the theory of automation of mechanical engineering design using computer technology*, Minsk, "Nauka I Tekhnika", 1970, p. 336.
Second Office Action dated Mar. 11, 2021, issued in Russian Patent Application No. 2020117336 (6 pages).
First Office Action dated Sep. 23, 2020, issued in corresponding Russian Application No. 2020115573.
Office Action issued in Korean Patent Application No. KR 10-2020-7015185, dated Feb. 22, 2022 (6 pages).
Office Action issued in Korean Patent Application No. KR 10-2020-7015221, dated Feb. 4, 2022 (7 pages).
International Search Report for International Application No. PCT/CN2018/111797, dated Jan. 8, 2019.

* cited by examiner

HEAT TRANSFER ENHANCEMENT PIPE AS WELL AS CRACKING FURNACE AND ATMOSPHERIC AND VACUUM HEATING FURNACE INCLUDING THE SAME

CROSS-REFERENCE TO RELATED APPLICATIONS

This application is a national stage application under 35 U.S.C. § 371 of International Application No. PCT/CN2018/111797, filed Oct. 25, 2018, which claims the priority to and benefits of Chinese Patent Application No. 201711029500.8, filed Oct. 27, 2017, Chinese Patent Application No. 201711023424.X, filed Oct. 27, 2017, Chinese Patent Application No. 201711056794.3, filed Oct. 27, 2017, Chinese Patent Application No. 201711027588.X, filed Oct. 27, 2017, and Chinese Patent Application No. 201711057043.3, filed Oct. 27, 2017, all of which are incorporated herein by reference in their entireties.

TECHNICAL FIELD

The invention relates to the field of fluid heat transfer technology, in particular to a heat transfer enhancement pipe as well as a cracking furnace and an atmospheric and vacuum heating furnace including the same.

BACKGROUND

The heat transfer enhancement pipe refers to a heat transfer element capable of enhancing fluid heat transfer between the interior and the outside of the pipe, that is, enabling unit heat transfer area to transfer as much heat as possible per unit time. The heat transfer enhancement pipes are used in many industries, such as thermal power generation, petrochemical, food, pharmaceutical, light industry, metallurgy, navel architecture, etc. The cracking furnace is an important equipment in petrochemical industry, therefore the heat transfer enhancement pipe has been widely used in the cracking furnace.

For a heat transfer enhancement pipe, there is a flow boundary layer between the fluid flow body and the pipe wall surface, and the heat transfer resistance is large. At the same time, due to the extremely low flow velocity in the boundary layer, coke is gradually deposited and adhered to the inner surface of the furnace pipe during the cracking process to form a dense coke layer, which coke layer is extremely large in heat transfer resistance. Therefore, the maximum resistance of the heat transfer pipe in the radiation section of the cracking furnace is in the boundary layer region of the inner wall of the pipe.

U.S. Pat. No. 5,605,400A discloses to enhance heat transfer by providing a fin on the internal wall of the heat transfer enhancement pipe. The fin not only increases surface area of the heat transfer enhancement pipe but also increases turbulent kinetic energy inside the pipe. The fin is in the form of a distorted blade. The fin is usually arranged in the interior of the heat transfer enhancement pipe to thin the boundary layer of the fluid via rotation of the fluid itself, thereby achieving the purpose of heat transfer enhancement. Although the heat transfer enhancement pipe with fin has a relatively good heat transfer enhancement effect, cracks can often occur between the fin and the pipe wall of the heat transfer enhancement pipe due to high stress at the welding site during operation, since the fin is connected with the pipe wall of the heat transfer enhancement pipe by welding. Especially in long-term operation combined with ultra-high temperature environment, it is more likely for cracks to occur between the fin and the pipe wall of the heat transfer enhancement pipe, thereby shortening service life of the heat transfer enhancement pipe.

Therefore, it is necessary to reduce thermal stress of the heat transfer enhancement pipe to increase service life of the heat transfer enhancement pipe, while ensuring heat transfer effect of the heat transfer enhancement pipe.

SUMMARY OF THE INVENTION

Objects of the present invention are to overcome issues of short service life of the heat transfer enhancement pipe existing in the prior art and to provide a heat transfer enhancement pipe capable of reducing its own thermal stress and thereby increasing service life of the heat transfer enhancement pipe.

In order to achieve the above objects, one aspect of the present invention provides a heat transfer enhancement pipe including a pipe body of tubular shape with an inlet for entering of a fluid and an outlet for said fluid to flow out, internal wall of the pipe body is provided with a fin protruding toward the interior of the pipe body and spirally extending in an axial direction of the pipe body, wherein a height of the fin gradually increases from one end in at least a part extension of the fin.

On the other aspect, the present invention provides a cracking furnace or an atmospheric and vacuum heating furnace comprising a radiation chamber, in which at least one furnace pipe assembly is installed; the furnace pipe assembly comprises a plurality of furnace pipes arranged in sequence and heat transfer enhancement pipe communicating adjacent furnace pipes, the heat transfer enhancement pipe is heat transfer enhancement pipe as described as above.

DESCRIPTION OF THE REFERENCE NUMBERS

1—heat transfer enhancement pipe; 10—pipe body; 100—inlet; 101—outlet; 11—fin; 110—first end surface; 111—top surface; 112—side wall face; 113—smooth transition fillet; 115—second end surface; 120—side wall; 12—interval; 13—hole; 14—heat insulator; 140—straight pipe section; 141—first tapered pipe section; 142—second tapered pipe section; 15—gap; 160—first connecting piece; 161—second connecting piece; 162—connecting rod; 17—heat insulating layer; 170—metal alloy layer; 171—ceramic layer; 172—oxide layer; 2—furnace pipe.

DETAILED DESCRIPTION OF EMBODIMENTS

In the present invention, without indicated on the contrary, words such as "up", "down", "left", and "right" used herein to define orientations generally refer to and are understood as orientations in association with the drawings and orientations in actual application; "interior" and "external" is relative to the axis of the heat transfer enhancement pipe.

In addition, the height of the fin refers to the height or distance between the top surface of the fin facing the central axis of the pipe body and the internal wall of the pipe body. The axial length of the fin refers to the length or distance of the fin along the central axis in the side view.

Figure 14:
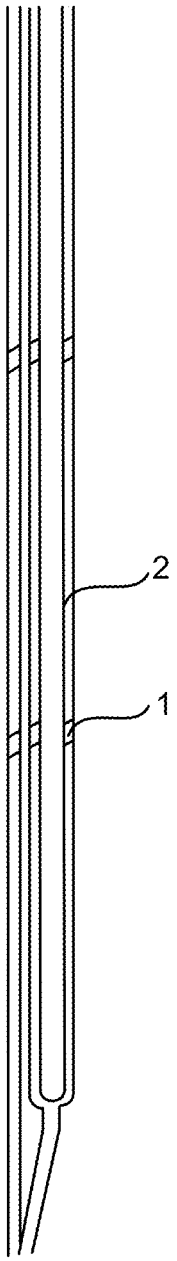
FIG. 14 is a structural schematic view of a furnace pipe assembly in the cracking furnace according to a preferred embodiment of the present invention.

The present invention proposes to provide a heat transfer enhancement pipe in a furnace pipe assembly, to enhance heat transfer, thereby reducing or preventing formation of coke layer. As shown in FIG. 14, a plurality of furnace pipe assembly are provided in a radiation chamber of a cracking furnace, each furnace pipe assembly is provided with heat transfer enhancement pipes 1. In each furnace pipe assembly, two heat transfer enhancement pipes 1 disposed at intervals along the axial direction of the furnace pipe 2. Each heat transfer enhancement pipe 1 has an internal diameter of 65 mm. In each furnace pipe assembly, the axial length of the furnace pipe 2 between two adjacent heat transfer enhancement pipes 1 is 50 times the internal diameter of the heat transfer enhancement pipe 1. It is to be understood that, the number and interval of the heat transfer enhancement pipes 1 may vary depending on particular applications, without departing from the scope of the present invention.

As shown in FIGS. 1-8, the heat transfer enhancement pipe 1 includes a pipe body 10 of tubular shape having an inlet 100 for entering of a fluid and an outlet 101 for said fluid to flow out. The internal wall of the pipe body 10 is provided with fin 11 protruding towards the interior of the pipe body 10 and spirally extending in an axial direction of the pipe body. In order to reduce thermal stress of the heat transfer enhancement pipe 1, the height of the fin 11, i.e. the distance between the top surface 111 of the fin 11 facing the central axis of pipe body 10 and the internal wall of pipe body 10, is preferably greater than 0 and less than or equal to 150 mm; for example, the height of the fin 11 can be 10 mm, 20 mm, 30 mm, 40 mm, 50 mm, 60 mm, 70 mm, 80 mm, 90 mm, 100 mm, 110 mm, 120 mm, 130 mm, or 140 mm.

Figure 1:
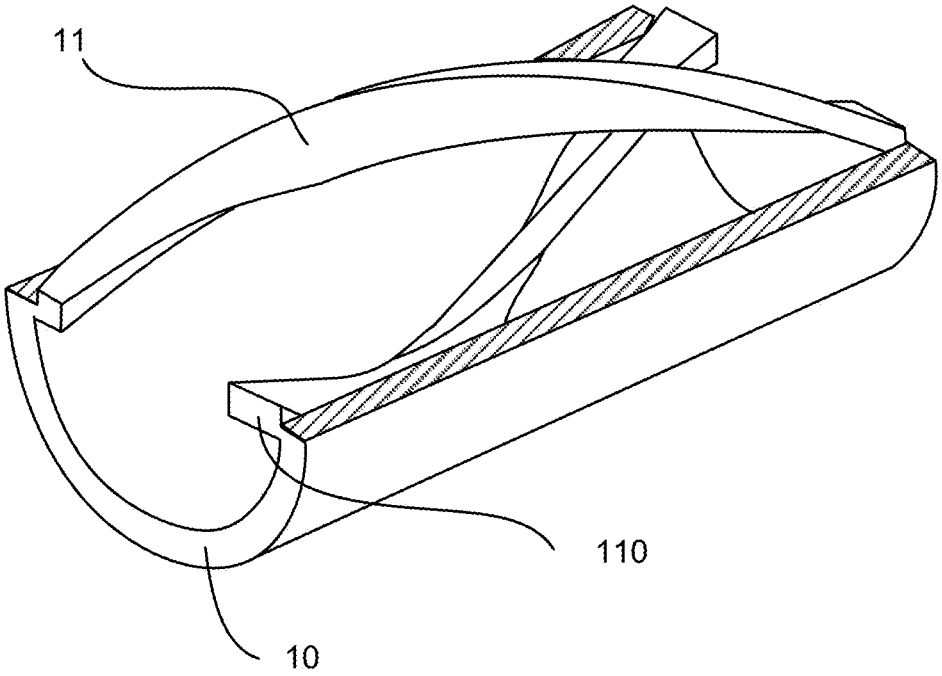
FIG. 1 is a partial cross-sectional schematic view of the heat transfer enhancement pipe according to a preferred embodiment of the present invention, wherein a height of the fin gradually increases from inlet end in at least a part extension of the fin.
Figure 2:
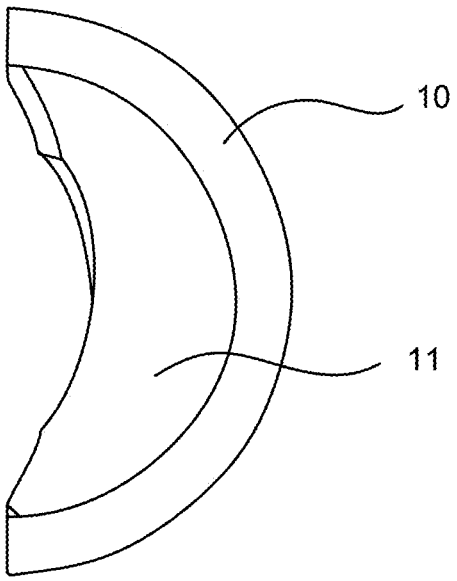
FIG. 2 is a perspective schematic view of the heat transfer enhancement pipe according to another preferred embodiment of the present invention, wherein the height of the fin gradually increases from both ends to the middle.
Figure 3:
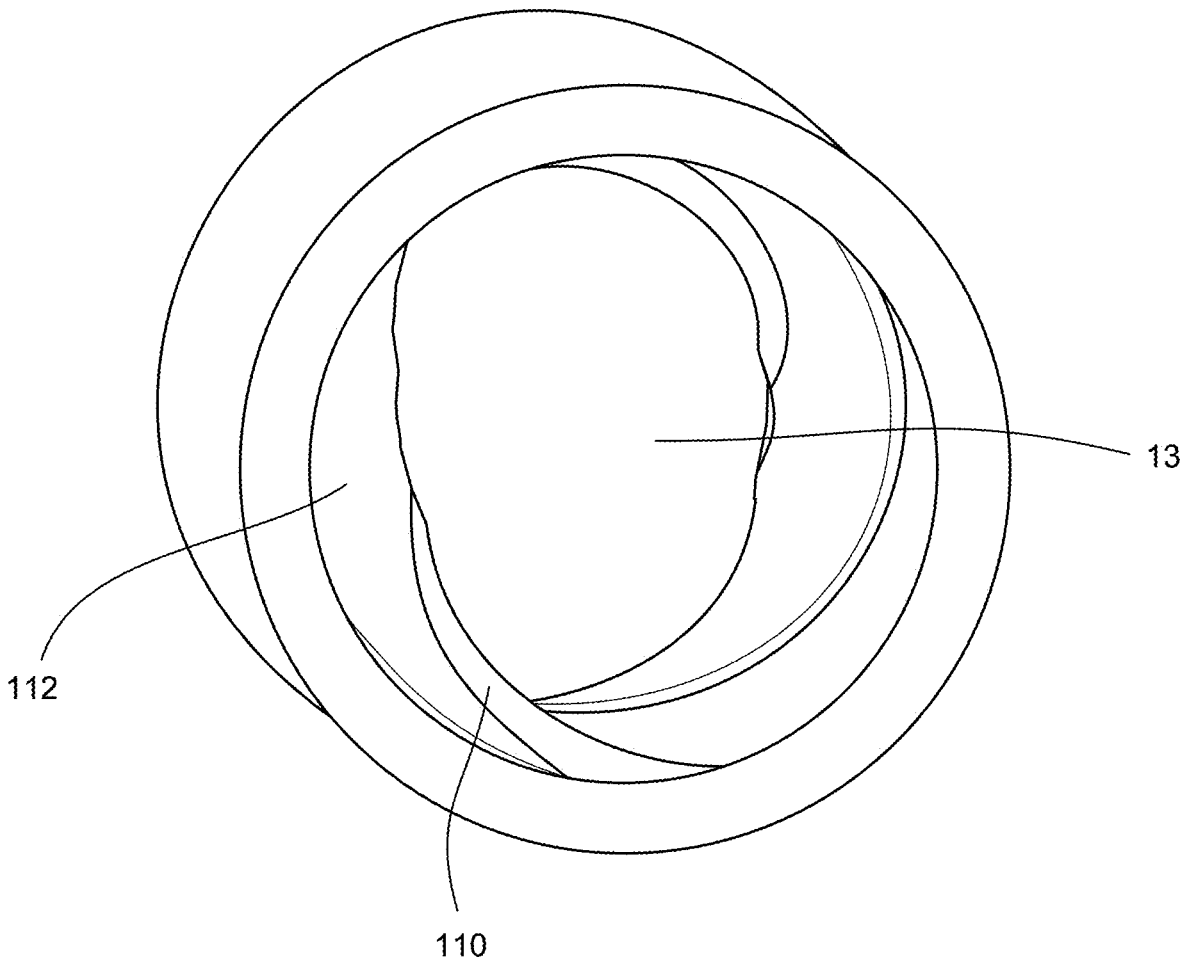
FIG. 3 is a perspective schematic view of the heat transfer enhancement pipe shown in FIG. 2, wherein the fin has a trapezoidal cross section; the transition angle is 35°.
Figure 4:
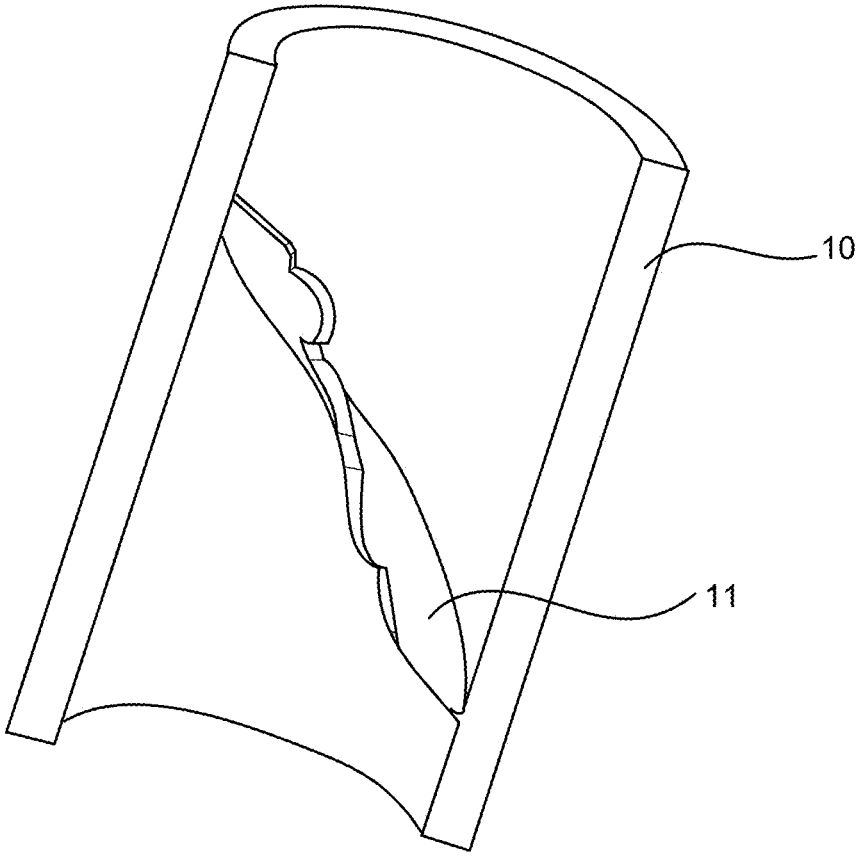
FIG. 4 is a perspective schematic view of the heat transfer enhancement pipe according to another preferred embodiment of the present invention, wherein the height of the fin gradually increases from both ends to the middle only in parts close to both ends, and in the middle part, the height of the fin varies wavily.
Figure 5:
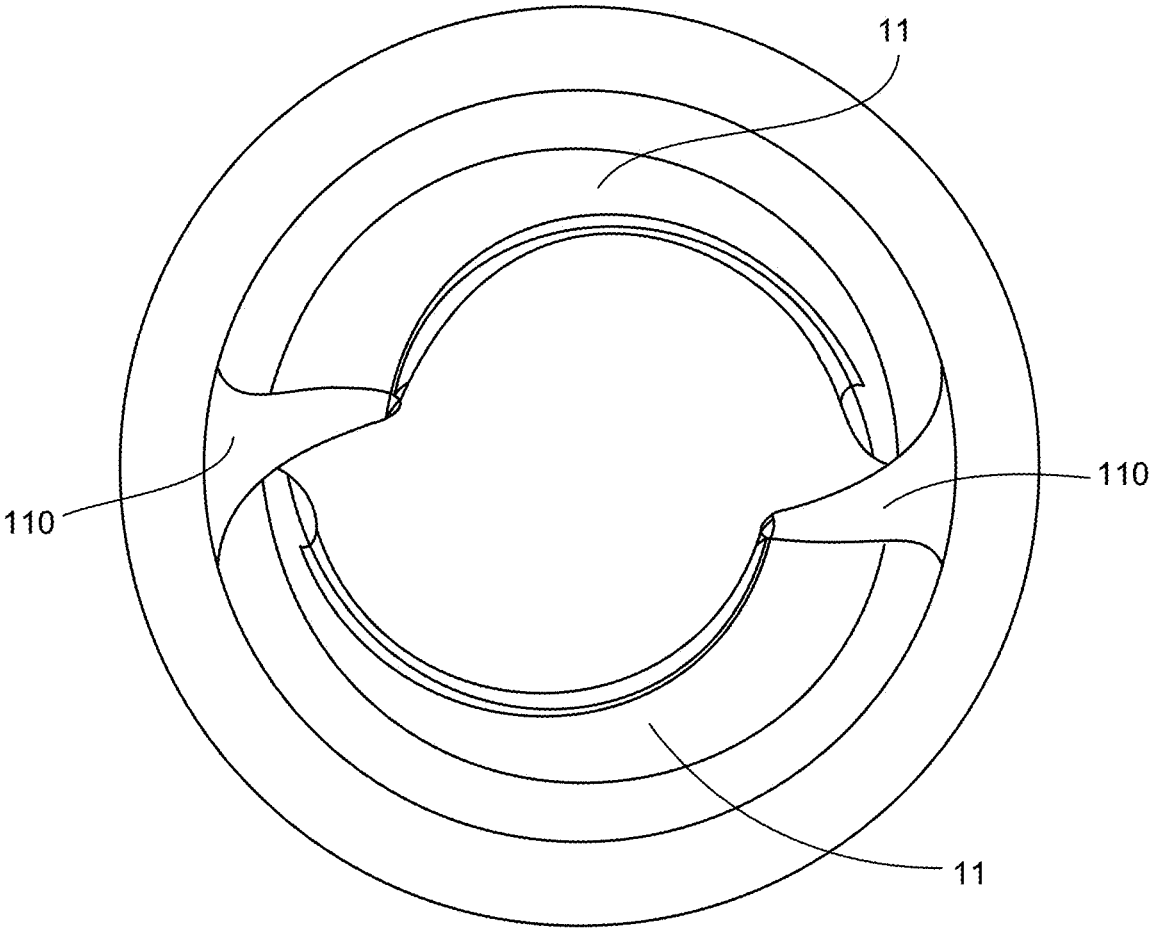
FIG. 5 is a perspective schematic view of the heat transfer enhancement pipe according to another embodiment of the present invention, wherein the fin has a trapezoidal cross section; the transition angle is 38°, the height of the fin gradually increases from outlet end.

According to one example, a height of the fin 11 gradually increases from one end in at least a part extension of the fin. In the example shown in FIG. 1, the height of the fin 11 gradually increases in an extending direction from the inlet 100 to the outlet 101; however, it is to be understood that, the height of the fin 11 may also gradually increases in an extending direction from the outlet 101 to the inlet 100, as shown in FIG. 5. In addition, the height of the fin 11 may also gradually increases in a direction from both ends to the middle, as shown in FIG. 2-3. In addition, the height of the fin 11 may also gradually increase from both ends to the middle only in parts close to both ends, and in the middle part, the height of the fin 11 varies wavily, as shown in FIG. 4.

Figure 10:
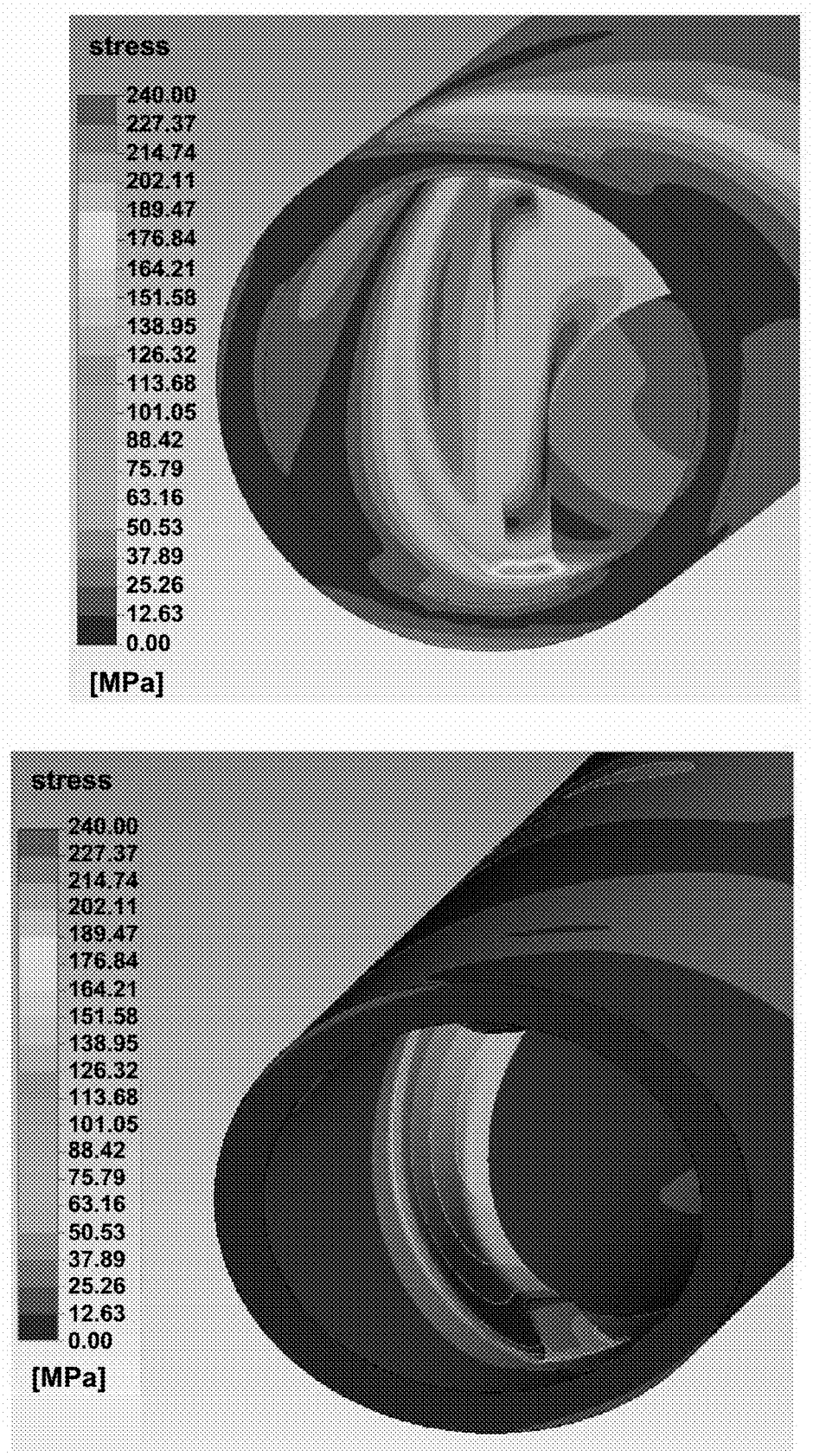
FIG. 10 is a stress distribution diagram of the heat transfer enhancement pipe of the present invention vs a prior art heat transfer pipe.
Figure 11:
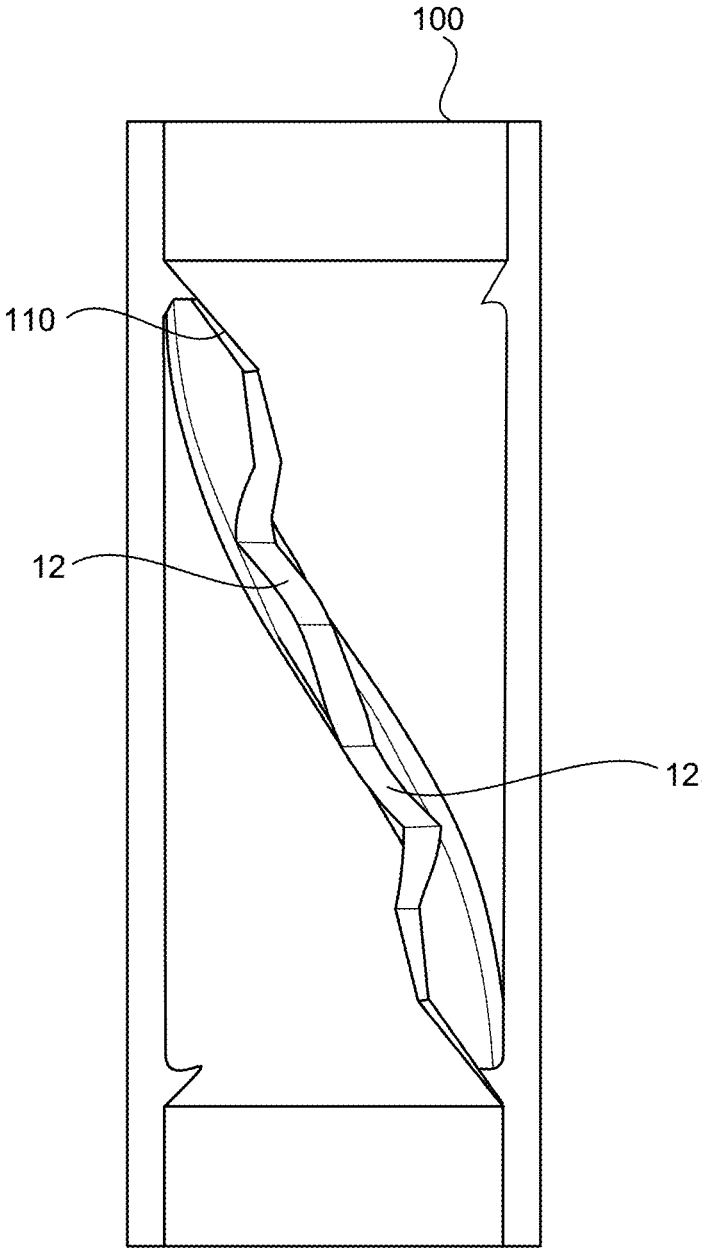
FIG. 11 is a perspective schematic view of the heat transfer enhancement pipe according to another preferred embodiment of the present invention, wherein the fin has a trapezoidal cross section, the number of intervals arranged at the fin is 2; the transition angle is 38°.

By providing on the internal wall of pipe body 10 with fin 11 protruding towards the interior of pipe body 10 and by causing the height of the fin 11 to gradually increase from one end, it thereby enables the heat transfer enhancement pipe to have a good heat transfer effect, while thermal stress of the heat transfer enhancement pipe 1 can be reduced and the ability to resist local over-temperature of the heat transfer enhancement pipe 1 is correspondingly improved, so as to increase service life of the heat transfer enhancement pipe. FIG. 10 is a stress distribution diagram of the heat transfer enhancement pipe of the present invention vs a prior art heat transfer pipe. As can be seen from FIG. 10, in the prior art heat transfer pipe, there is a significant stress concentration at the connection between the fins and the pipe wall of the reinforced heat transfer tube (as shown in the upper half of FIG. 10); as compared with the prior art heat transfer pipe, the thermal stress of the heat transfer enhancement pipe 1 of the present invention is significantly reduced (as shown in the lower half of FIG. 10).

In order to further reduce thermal stress of the heat transfer enhancement pipe 1, a ratio of the height of the highest part of the fin 11 to the height of the lowest part of the fin 11 is 1.1-1.6:1. For example, the ratio of the height of the highest part of the fin 11 to the height of the lowest part of the fin 11 is 1.2:1, 1.3:1, 1.4:1 or 1.5:1.

Further, a plurality of fins 11, for example, two, three, or four fins 11, can be arranged on the internal wall of pipe body 10. As viewed in the direction of inlet 100, the plurality of fins 11 can be clockwise or counterclockwise spiral. Configuring the plurality of fins 11 with the above structure not only improves heat transfer effect of the heat transfer enhancement pipe 1, but also reduces thermal stress of the heat transfer enhancement pipe 1, improves the ability of the heat transfer enhancement pipe 1 to resist high temperature, and greatly extends service life of the heat transfer enhancement pipe 1.

Preferably, as viewed in the direction of inlet 100, the plurality of fins 11 can be enclosed at the center of pipe body 10 to form a hole 13 extending in the axial direction of pipe body 10 to facilitate the flow of the fluid into pipe body 10 and to reduce pressure drop. In order to reduce pressure drop to as low as possible, the ratio d: D between diameter d of hole 13 and internal diameter D of pipe body 10 can preferably be greater than 0 and less than 1; for example, the ratio d: D can be 0.1, 0.2, 0.3, 0.4, 0.5, 0.6, 0.7, 0.8, or 0.9.

In order to increase disturbance effect of fin 11 to the fluid, the rotational angle of fin 11 can preferably be 90-1080°; for example, the rotational angle of fin 11 can be 120°, 180°, 360°, 720°, or 1080°.

Generally, the ratio of the axial length of fin 11 rotated by 180° to internal diameter D of pipe body 10 is a distortion ratio that determines the length of each fin 11; while the rotational angle of fin 11 determines the degree of distortion and affects heat transfer efficiency. The distortion ratio of fin 11 can be 2.3 to 2.6; for example, the distortion ratio of fin 11 can be 2.35, 2.4, 2.5, 2.49, or 2.5.

In addition, the ratio $L_1$:D of length $L_1$ of fin 11 in the axial direction of pipe body 10 to internal diameter D of pipe body 10 is 1-10:1; preferably, the ratio $L_1$:D=1-6:1.

The present invention also provides a cracking furnace comprising a radiation chamber, in which at least one furnace pipe assembly is mounted, as shown in FIG. 14. The furnace pipe assembly comprises a plurality of furnace pipes 2 sequentially arranged, in which heat transfer enhancement pipes, i.e. the heat transfer enhancement pipes 1, communicating adjacent furnace pipes 2 can be axially arranged in a spaced manner; the heat transfer enhancement pipes are the heat transfer enhancement pipes 1 provided by present invention. By arranging the heat transfer enhancement pipe 1 provided by the present invention in the radiation chamber of the cracking furnace, not only heat transfer effect of the fluid in the radiation chamber can be improved, but also operating cycle of the cracking furnace and its ability to resist high temperature are improved due to the reduction of thermal stress of the heat transfer enhancement pipe 1. Specifically, the furnace pipe assembly can be provided with 2, 3, 4, 5, 6, 7, 8, 9, or 10 heat transfer enhancement pipes 1.

Preferably, the ratio $L_2$:D of axial length $L_2$ of furnace pipe 2 to internal diameter D of pipe body 10 is 15-75, so that heat transfer effect and operating cycle of the cracking furnace can be further improved. It is further preferred that the ratio $L_2$:D=25-50.

Effects of the present invention will be further illustrated through embodiments and comparative examples in the following.

EXAMPLE 11

A plurality of the furnace pipe assemblies are arranged in a radiation chamber of a cracking furnace. The heat transfer enhancement pipes 1 are arranged in three of the furnace pipe assemblies. Two heat transfer enhancement pipes 1 are arranged in each furnace pipe assembly at intervals in axial direction of the furnace pipe 2. Each heat transfer enhancement pipe 1 has an internal diameter of 65 mm. In each furnace pipe assembly, the axial length of the furnace pipe 2 between two adjacent heat transfer enhancement pipes 1 is 50 times the internal diameter of the heat transfer enhancement pipe 1. Structure of each of the heat transfer enhancement pipes 1 is as follow: two fins 11 are arranged on the internal wall of pipe body 10; as viewed from the direction of inlet 100, two fins 11 take shapes of clockwise spirals; two fins 11 enclose at the center of pipe body 10 to form hole 13 extending in the axial direction of pipe body 10; the ratio of the diameter of hole 13 to the internal diameter of pipe body 10 is 0.6; the rotation angle of each of the fins 11 is 180°; the distortion ratio of each of the fins 11 is 2.5, the height of the fin 11 gradually increases in the extending direction from the inlet 100 to the outlet 101, the ratio of the height of the highest part of the fin 11 and the height of the lowest part of the fin 11 is 1.3:1, wherein the outlet temperature of the cracking furnace is 820-830°.

EXAMPLE 12

Example 12 is the same as Example 11 except that: the height of the fin 11 may also gradually increase in the extending direction from the outlet 101 to the inlet 100, the ratio of the height of the highest part of the fin 11 and the height of the lowest part of the fin 11 is 1.4:1. Other conditions remain unchanged.

EXAMPLE 13

Example 13 is the same as Example 11 except that: the height of the fin 11 may also gradually increase in direction from both ends to the middle. Other conditions remain unchanged.

COMPARATIVE EXAMPLE 11

The heat transfer enhancement pipe of the prior art is arranged, wherein in the pipe body is provided with only one fin that extends spirally in the axial direction of the pipe body and separates the interior of the pipe body into two mutually non-communicating chambers, with the remaining conditions unchanged.

Respective test results of the cracking furnaces in the examples and the comparative example after operating under same conditions are shown in Table 1 below.

TABLE 1

| | Test items | | | |
|---|---|---|---|---|
| No. | Heat transfer load/W | Pressure drop/MPa | Maximum thermal stress/MPA | Service life/year |
| Example 11 | 93230 | 0.10965 | 55 | 6-7 |
| Example 12 | 93120 | 0.10980 | 58 | 6-7 |
| Example 13 | 93400 | 0.10922 | 52 | 6-7 |
| Comparative Example 11 | 88080 | 0.120909 | 110 | 4-5 |

It can be known from the above that arranging the heat transfer enhancement pipe provided by the present invention in the cracking furnace increases heat transfer load maximally by 6620 w, significantly increases heat transfer efficiency, and significantly reduces pressure drop, while increasing service life of the heat transfer enhancement pipe due to maximum thermal stress reduction of the heat transfer enhancement pipe being over 50%.

According to one example, the fins 11 may extend continuously or in sections. When the fins 11 extend in sections, the fins 11 include a plurality of the fin sections divided by intervals 12. Similarly, when the fins 11 extend continuously, the fins 11 may be considered to include a single fin section. Therefore, the fins 11 have one or more fin sections extending spirally in the axial direction of the pipe body 10. It is to be understood that the length of each fin section may be the same or different. In addition, each fin section includes a first end surface facing the inlet 100 and a second end surface facing the outlet 101. At least one of the first end surface and the second end surface of at least one of the fin sections is formed as a transition surface along a spiral extending direction. In order to facilitate the distinction, in the present application, the first end surface 110 closest to the inlet 100 is referred to as the first transition surface; the second end surface 115 closest to the outlet 101 is referred to as the second transition surface; the first end surface and the second end surface defined by the side walls 120 of the intervals 12 are referred to as the fourth transition surface. When the first end surface and/or the second end surface of the plurality of the fin sections are transition surfaces, the transition surfaces formed by the first end surface and/or the second end surface of each fin section may be the same or different.

In addition, it should be noted that the transition surface may be a curved face or a flat face. The curved face may be convex or concave. Preferably, the curved face is concave to further improve the heat transfer effect of the heat transfer enhancement pipe and to further reduce the thermal stress of the heat transfer enhancement pipe. In addition, the transition surface can also reduce the impact force of the fluid on the fins. "Transition angle" refers to the angle between the transition surface or the tangent plane of the transition surface (when the transition surface is a curved face) and the tangent plane of the pipe wall at the connection position. The transition angle extends at an angle greater than or equal to 0° and less than 90°.

As shown in FIGS. 1-5, the first end surface 110 of fin 11 closest to the inlet 100 is formed as the first transition surface in a spirally extending direction. By providing on the internal wall of pipe body 10 with fin 11 protruding towards the interior of pipe body 10 and by forming the first end surface 110 of fin 11 closest to the inlet 100 as the first transition surface in a spirally extending direction, it thereby enables the heat transfer enhancement pipe to have a good heat transfer effect, while thermal stress of the heat transfer enhancement pipe 1 can be reduced and the ability to resist local over-temperature of the heat transfer enhancement pipe 1 is correspondingly improved, so as to increase service life of the heat transfer enhancement pipe; furthermore, the first end surface 110 forming as the first transition surface has a relatively strong turbulent effect on the fluid in pipe body 10 and reduces coking phenomenon.

The aforementioned heat transfer enhancement pipe 1 is suitable for heating furnaces and is also suitable for cracking furnaces. The aforementioned heat transfer enhancement pipe 1 can be installed in cracking furnaces such as ethylene cracking furnaces, so that the fluid in transit can enter into pipe body 10 of the heat transfer enhancement pipe 1 through inlet 100; afterwards, under the influence of the fin 11, the fluid becomes a swirling flow; due to its tangential velocity, the fluid can destroy the boundary layer, reduces the rate of coking, and extends service cycle of the cracking furnaces; meanwhile, since the first end surface 110 of the fin 11 closest to the inlet 100 is formed as the first transition surface in a spirally extending direction, thermal stress of the heat transfer enhancement pipe 1 is thereby reduced and service life of the heat transfer enhancement pipe 1 extended. Wherein FIG. 4 clearly shows the first transition surface forming in the spirally extending direction; wherein the first end surface 110 is sloped in the spirally extending direction. The aforementioned heat transfer enhancement pipe 1 is suitable for heating furnaces and is also suitable for cracking furnaces. Additionally, it should be noted that the fluid in the heat transfer enhancement pipe 1 is not specifically limited and can be selected according to actual application environment of the heat transfer enhancement pipe 1.

In addition, the first transition surface can be formed as a first curved face. The first curved face can be either convex or concave shape; preferably, the first curved face is of concave shape so as to further improve heat transfer effect of the heat transfer enhancement pipe 1 and further reduce thermal stress of the heat transfer enhancement pipe 1. Specifically, the first curved face can be a partial paraboloid taken from a paraboloid.

In addition, the transition angle of the first transition surface can be greater than or equal to 0° and less than 90°, so as to further reduce thermal stress of the heat transfer enhancement pipe 1 and greatly increase service life of the heat transfer enhancement pipe 1. The transition angle of the first transition surface can be 10°, 15°, 20°, 25°, 30°, 35°, 38°, 40°, 45°, 50°, 55°, 60°, 65°, 70°, 75°, 80°, or 85°.

In order to further reduce thermal stress of the heat transfer enhancement pipe 1, the second end surface of the fin 11 closest to the outlet 101 can be formed as the second transition surface in a spirally extending direction; wherein the second end surface 110 is sloped in the spirally extending direction, so as to correspondingly increase service life of the heat transfer enhancement pipe. In addition, the second transition surface can be formed as a second curved face. The second curved face can be either convex or concave shape; preferably, the second curved face can be of concave shape. In addition, the transition angle of the second transition surface can be greater than or equal to 0° and less than 90°, so as to further reduce thermal stress of the heat transfer enhancement pipe 1 and greatly increase service life of the heat transfer enhancement pipe 1. The transition angle of the second transition surface can be 10°, 15°, 20°, 25°, 30°, 35°, 38°, 40°, 45°, 50°, 55°, 60°, 65°, 70°, 75°, 80°, or 85°.

Figure 12:
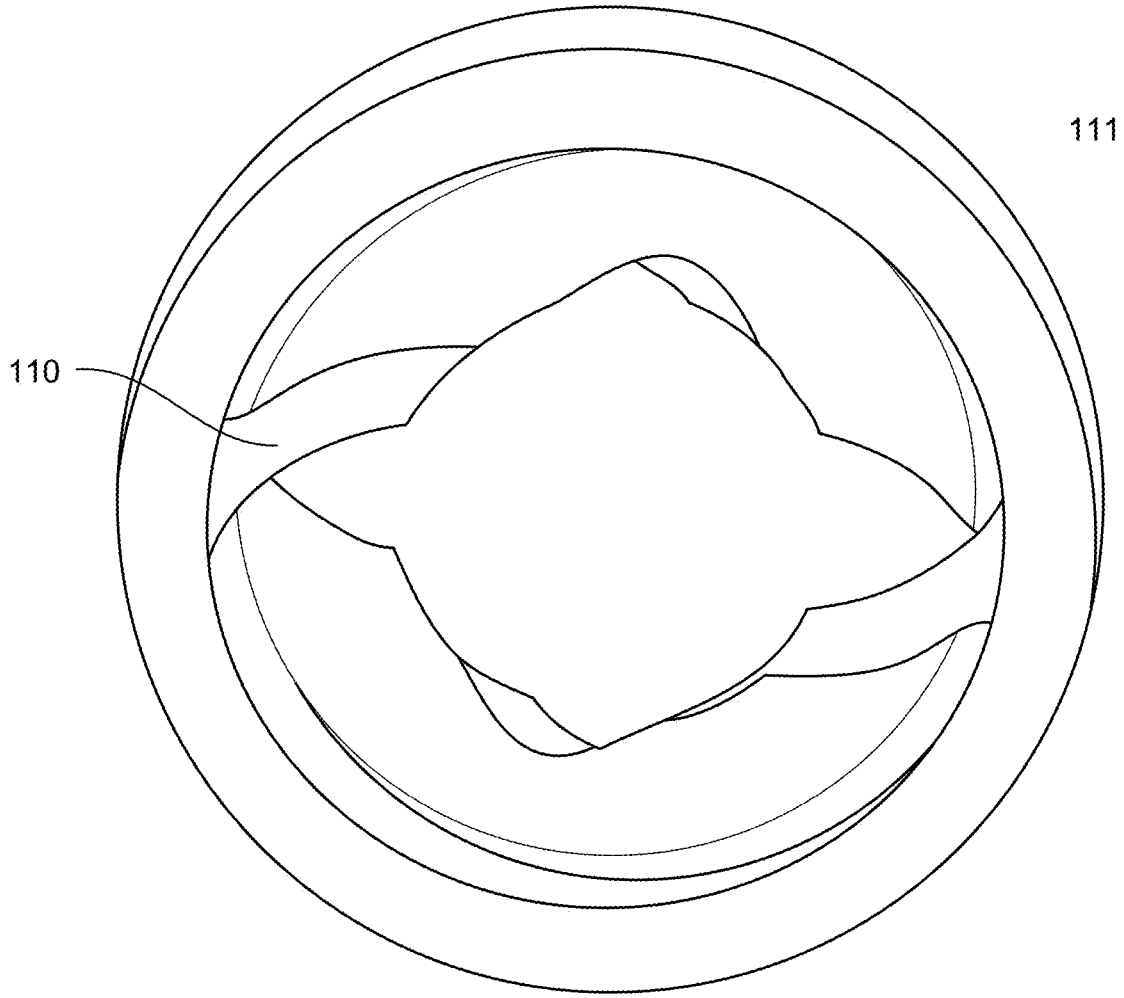
FIG. 12 is a perspective schematic view of the heat transfer enhancement pipe according to another preferred embodiment of the present invention, wherein the fin has a trapezoidal cross section, the transition angle is 35°, and the top surface of the fin facing the central axis of the pipe body is formed as the third transition surface of concave shape.
Figure 13:
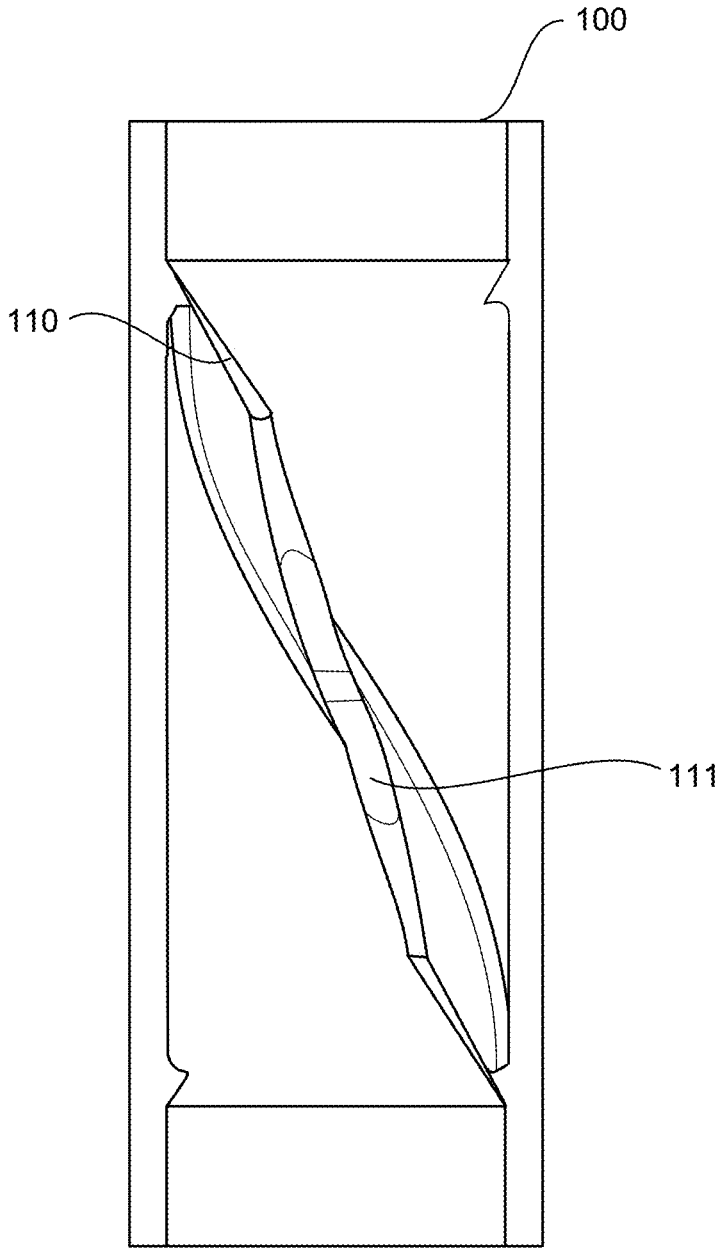
FIG. 13 is a cross-sectional structural schematic view of the heat transfer enhancement pipe shown in FIG. 12.

As shown in FIG. 12, the top surface 111 of the fin 11 facing the central axis of pipe body 10 can be formed as the third transition surface, so as to reduce thermal stress of the heat transfer enhancement pipe 1 without affecting heat transfer effect of the heat transfer enhancement pipe 1. It is further preferred for the third transition surface to be concave. Specifically, the third transition surface takes form of a paraboloid.

Preferably, two opposite side wall faces 112 of the fin 11 gradually approach to each other in a direction from the internal wall of pipe body 10 to the center of pipe body 10; that is to say, each of the side wall faces 112 can be inclined, so as to enable fin 11 to enhance disturbance to the fluid entering into pipe body 10 and improve heat transfer effect, while further reducing thermal stress of the heat transfer enhancement pipe 1. It is also understood that the cross section of the fin 11, which is the cross section taken from a plane parallel to a radial direction of pipe body 10, can substantially be trapezoidal or trapezoidal-like. Of course, the cross section of the fin 11 can substantially be rectangular.

In order to reduce thermal stress of the heat transfer enhancement pipe 1, a smooth transition fillet 113 can be formed at the connection of at least one of two opposite side wall faces 112 of the fin 11 with the internal wall of pipe body 10. Further, the radius of smooth transition fillet 113 is greater than 0 and less than or equal to 10 mm. Setting the radius of smooth transition fillet 113 within the above range can further reduce thermal stress of the heat transfer enhancement pipe 1 and increase service life of the heat transfer enhancement pipe 1. Specifically, the radius of smooth transition fillet 113 can be 5 mm, 6 mm, or 10 mm.

In addition, the angle formed by each of the side wall faces 112 and the internal wall of pipe body 10 at the connection with each other can be 5° to 90°; that is to say, the angle between the tangential planes of each of the side wall faces 112 and the internal wall of pipe body 10 at the connection with each other can be 5° to 90°; setting the angle within the above range can further reduce thermal stress of the heat transfer enhancement pipe 1 and increase service life of the heat transfer enhancement pipe 1. The angle formed by each of the side wall faces 112 and the internal wall of pipe body 10 at the connection with each other can be 20°, 30°, 40°, 45°, 50°, 60°, 70°, or 80°.

Figure 7:
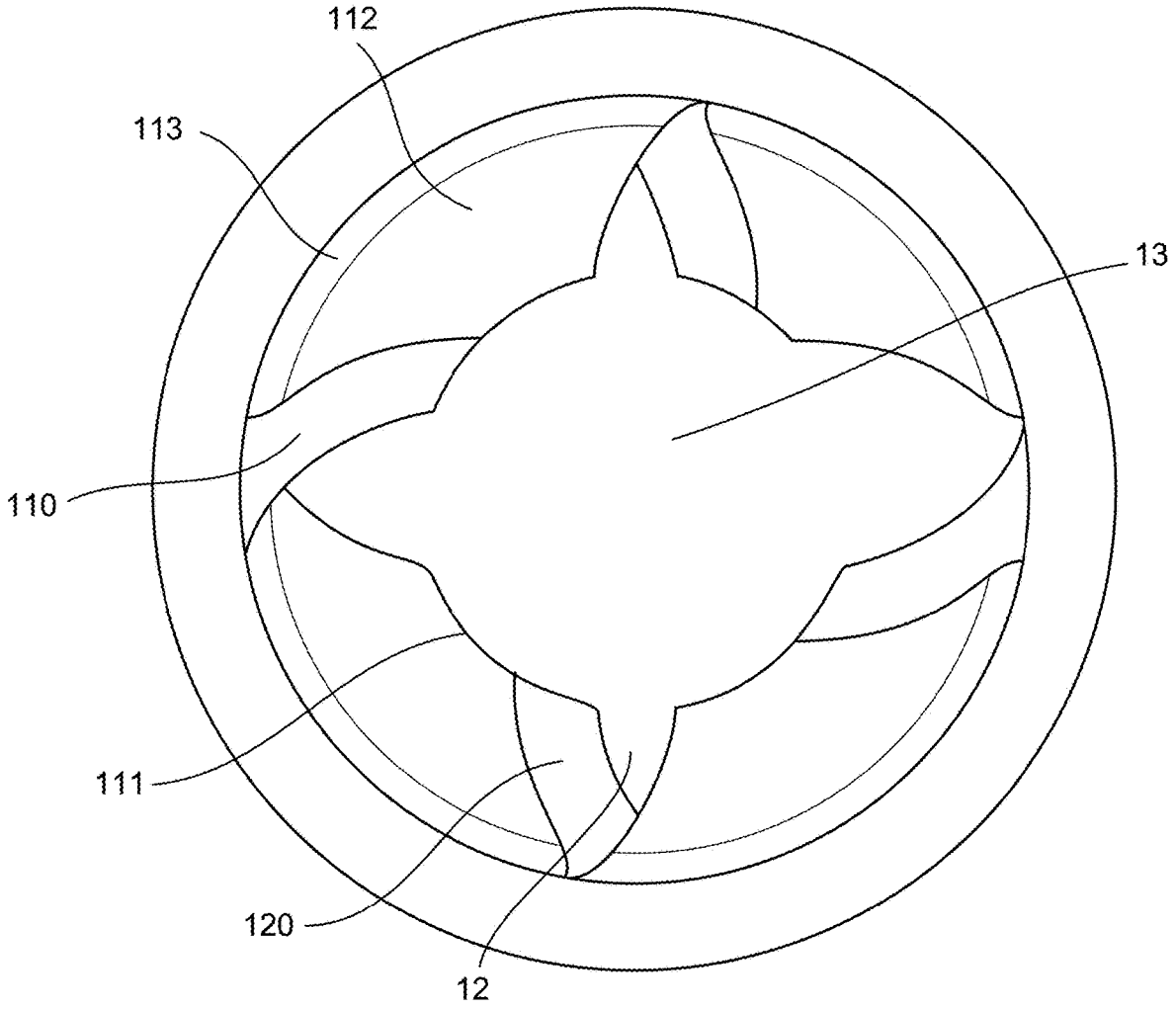
FIG. 7 is an end view of the heat transfer enhancement pipe according to another preferred embodiment of the present invention, wherein the fin has a trapezoidal cross section, the number of intervals arranged at the fin is 1; the transition angle is 35°.
Figure 8:
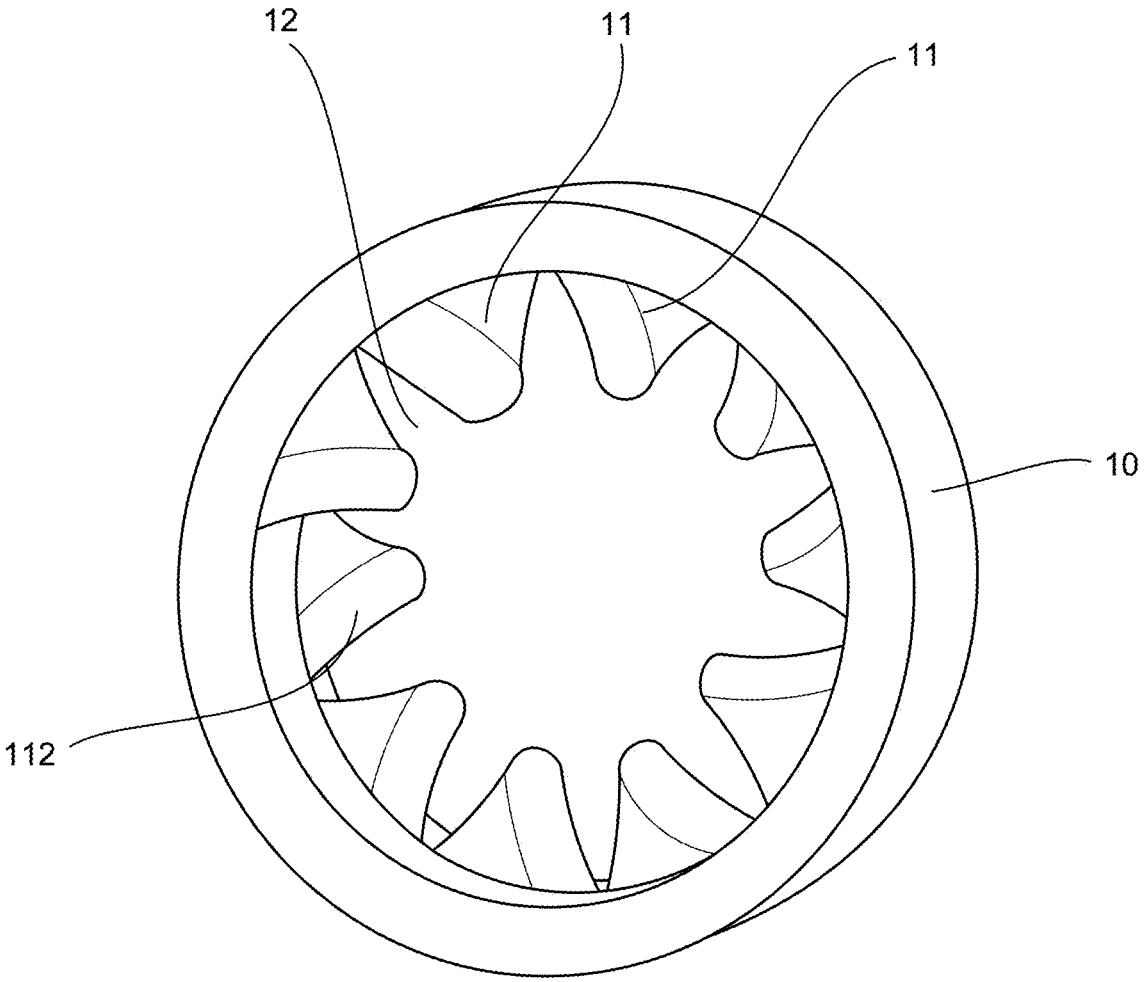
FIG. 8 is a side perspective schematic view of the heat transfer enhancement pipe according to another preferred embodiment of the present invention, wherein the cross-section of the fin is triangular-shaped viewed from aside.
Figure 9:
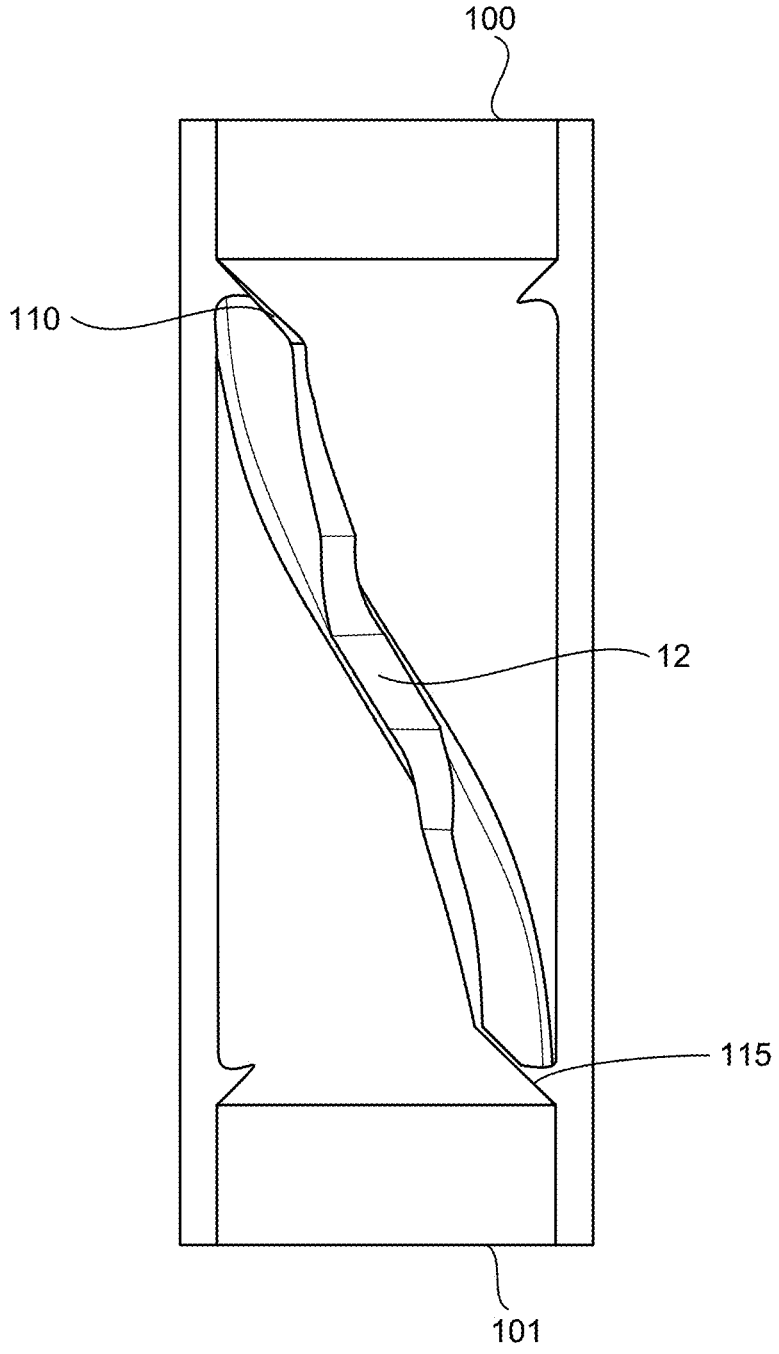
FIG. 9 is a perspective schematic view of the heat transfer enhancement pipe according to another preferred embodiment of the present invention, wherein the fin has a trapezoidal cross section, the number of intervals arranged at the fin is 1; the transition angle is 35°.

As shown in connection with FIG. 7-9, intervals 12 can be arranged on fin 11 to separate fin 11 so that not only the heat transfer enhancement pipe 1 has a good heat transfer effect, but also thermal stress of the heat transfer enhancement pipe 1 can be reduced, while the ability to resist local overtemperature can be improved. When the heat transfer enhancement pipe 1 provided with intervals 12 is applied to a heating furnace or a cracking furnace, operating cycle of the heating furnace or cracking furnace can also be increased. Wherein the number of intervals 12 is not specifically limited and can be selected according to actual needs. For example, it can be provided with one interval 12, or two, three, four, or five intervals 12. When provided with a plurality of intervals 12, the plurality of intervals 12 are preferably arranged in the extending direction of fin 11.

Figure 6:
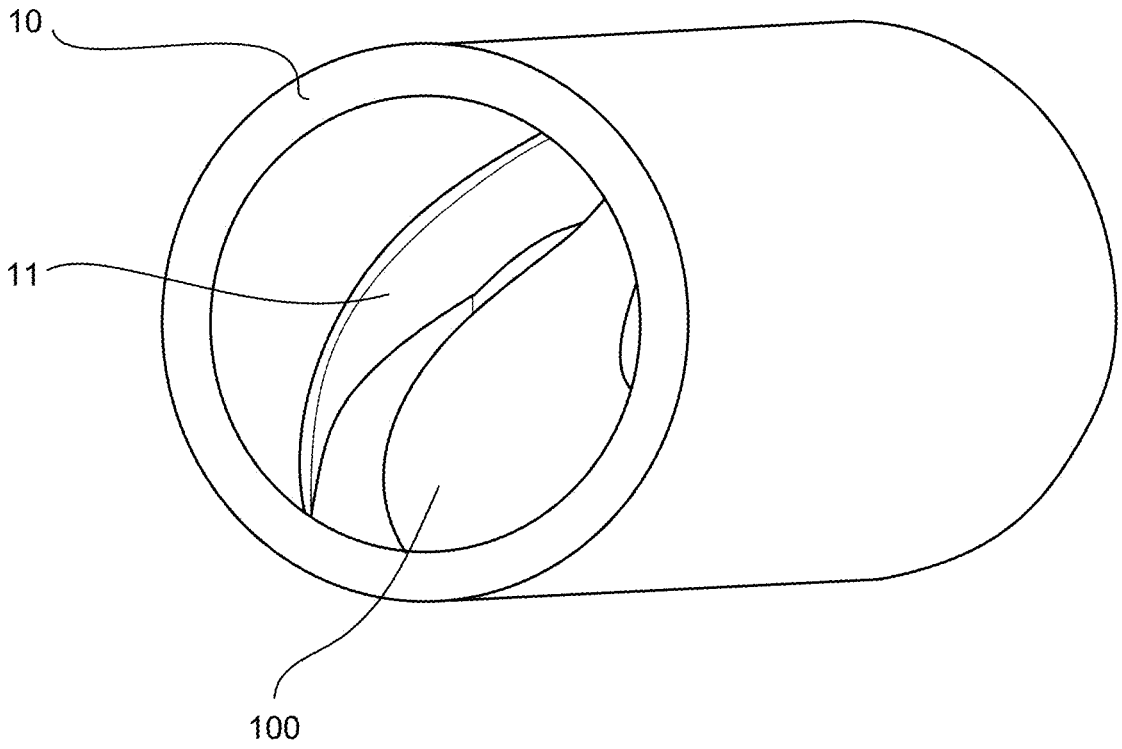
FIG. 6 is a perspective schematic view of the heat transfer enhancement pipe according to another preferred embodiment of the present invention, wherein the fin has a trapezoidal cross section; the transition angle is 35°.

Preferably, at least one of two sidewalls 120 of intervals 12 is formed as the fourth transition surface. For example, as shown in FIG. 6-7, and FIG. 10, both of the sidewalls 120 of intervals 12 can be formed as transition surfaces, and the distance between two sidewalls 120 gradually increases in a direction from close to the internal wall of pipe body 10 to away from the internal wall of pipe body 10. Wherein the distance between two sidewalls 120, i.e. the width of intervals 12, can be greater than 0 and less than or equal to 10000 mm; for example, the distance between two sidewalls 120 can be 1000 mm, 2000 mm, 3000 mm, 4000 mm, 5000 mm, 6000 mm, 7000 mm, 8000mm, or 9000mm. In addition, the fourth transition surface can be concave toward a direction facing away from the center of intervals 12.

Effects of the present invention will be further illustrated through Examples and comparative Examples in the following.

EXAMPLE 21

Example 21 is the same as Example 11, except that: the first transition surface and the second transition surface are provided, the transition angle of the first transition surface is 40°; the transition angle of the second transition surface is 40°.

EXAMPLE 22

Example 22 is the same as Example 21 except that: the ratio of the height of the highest part of the fin 11 to the height of the lowest part of the fin 11 is 1.4:1, the transition angle of the first transition surface is 35°; the transition angle of the second transition surface is 35°, the cross section of each fin 11, i.e. the cross section taken from a surface in the radial direction parallel to pipe body 10, is substantially triangular-shaped. Other conditions remain unchanged.

EXAMPLE 23

Example 23 is the same as Example 21 except that: the heat transfer enhancement pipes 1 is used in an atmospheric and vacuum heating furnace, each heat transfer enhancement pipe 1 has an internal diameter of 75 mm, the transition angle of the first transition surface is 60°; the transition angle of the second transition surface is 60°, outlet temperature of the heating furnace is 406°.

COMPARATIVE EXAMPLE 21

Comparative Example 21 is the same as Example 21, except that: the structure of the enhanced heat transfer tube is changed, that is, the heat transfer enhancement pipe of the prior art is arranged, wherein in the pipe body is provided with only one fin that extends spirally in the axial direction of the pipe body and separates the interior of the pipe body into two mutually non-communicating chambers, with the remaining conditions unchanged.

COMPARATIVE EXAMPLE 22

Comparative Example 22 is the same as Example 23, except that: the structure of the enhanced heat transfer tube is changed, that is, the heat transfer enhancement pipe of the prior art is arranged, wherein in the pipe body is provided with only one fin that extends spirally in the axial direction of the pipe body and separates the interior of the pipe body into two mutually non-communicating chambers, with the remaining conditions unchanged.

1. Respective test results of the cracking furnaces in the Examples 21-22 and the comparative example 21 after operating under same conditions are shown in Table 2.1 below.

TABLE 2.1

| | Test items | | | |
|---|---|---|---|---|
| No. | Heat transfer load/W | Pressure drop/MPa | Maximum thermal stress/MPA | Service life/year |
| Example 21 | 93710 | 0.10912 | 50 | 6-7 |
| Example 22 | 94630 | 0.10850 | 55 | 6-7 |
| Comparative example 21 | 88080 | 0.120909 | 110 | 4-5 |

It can be known from the above that arranging the heat transfer enhancement pipe provided by the present invention in the cracking furnace increases heat transfer load maximally by 6550 w, significantly increases heat transfer efficiency, and significantly reduces pressure drop, while increasing service life of the heat transfer enhancement pipe due to maximum thermal stress reduction of the heat transfer enhancement pipe being over 50%.

2. Respective test results of the cracking furnaces in the Example 23 and the comparative example 22 after operating under same conditions are shown in Table 2.2 below.

TABLE 2.2

| | Test items | |
|---|---|---|
| No. | Outlet temperature/° C. | Maximum thermal stress/MPA |
| Example 23 | 406 | 32 |
| Comparative example 22 | 396 | 60 |

It can be known from the above that applying the heat transfer enhancement pipe provided by the present invention in the atmospheric and vacuum heating furnace, makes the atmospheric and vacuum heating furnace to have better heat transfer effect, and makes the heat transfer enhancement pipe to have less thermal stress.

According to another example, the outside of the pipe body 10 is provided with a heat insulator 14 at least partially surrounding the external circumference of the pipe body 10. By providing the outside of the pipe body 10 with heat insulator 14 at least partially surrounding the external circumference of the pipe body 10, heat transfer between high-temperature gas and the external wall of the pipe body 10 is impeded to reduce temperature of the external wall of the pipe body 10, thereby reducing temperature difference between the pipe body 10 and the fin 11, so as to effectively reduce thermal stress of the heat transfer enhancement pipe 1, extend service life of the heat transfer enhancement pipe 1, and correspondingly increase the allowable temperature of the heat transfer enhancement pipe 1. When applying the aforementioned heat transfer enhancement pipe 1 to a cracking furnace, long-term stable operation of the cracking furnace can be ensured. Since the fins 11 are arranged in the interior of the pipe body 10, the fluid entering into pipe body 10 can turn into a swirling flow; due to its tangential velocity, the fluid can destroy the boundary layer and reduces the rate of coking. It is to be understood that the heat insulator 14 can completely surround the external circumference of the pipe body 10 at the circumference of the pipe body 10, i.e. at 360° around the external circumference of the pipe body 10; the heat insulator 14 can also partially surround the external circumference of the pipe body 10 at the circumference of the pipe body 10, e.g. at 90° around the external circumference of the pipe body 10; of course, the heat insulator 14 can surround the external circumference of the pipe body 10 with a suitable angle according to actual needs; it should be noted that, when applying the aforementioned heat transfer enhancement pipe 1 to a cracking furnace and providing the heat insulator 14 that partially surrounds the external circumference of the pipe body 10 at the outside of the pipe body 10, it is preferable to provide the heat insulator 14 at a heated surface of the pipe body 10. In addition, the heat insulator 14 can preferably be arranged at the outside of the pipe body 10 that is provided with the fins, so that the fins are not easily cracked away from pipe body 10, and service life of the heat transfer enhancement pipe 1 can be increased.

Figure 15:
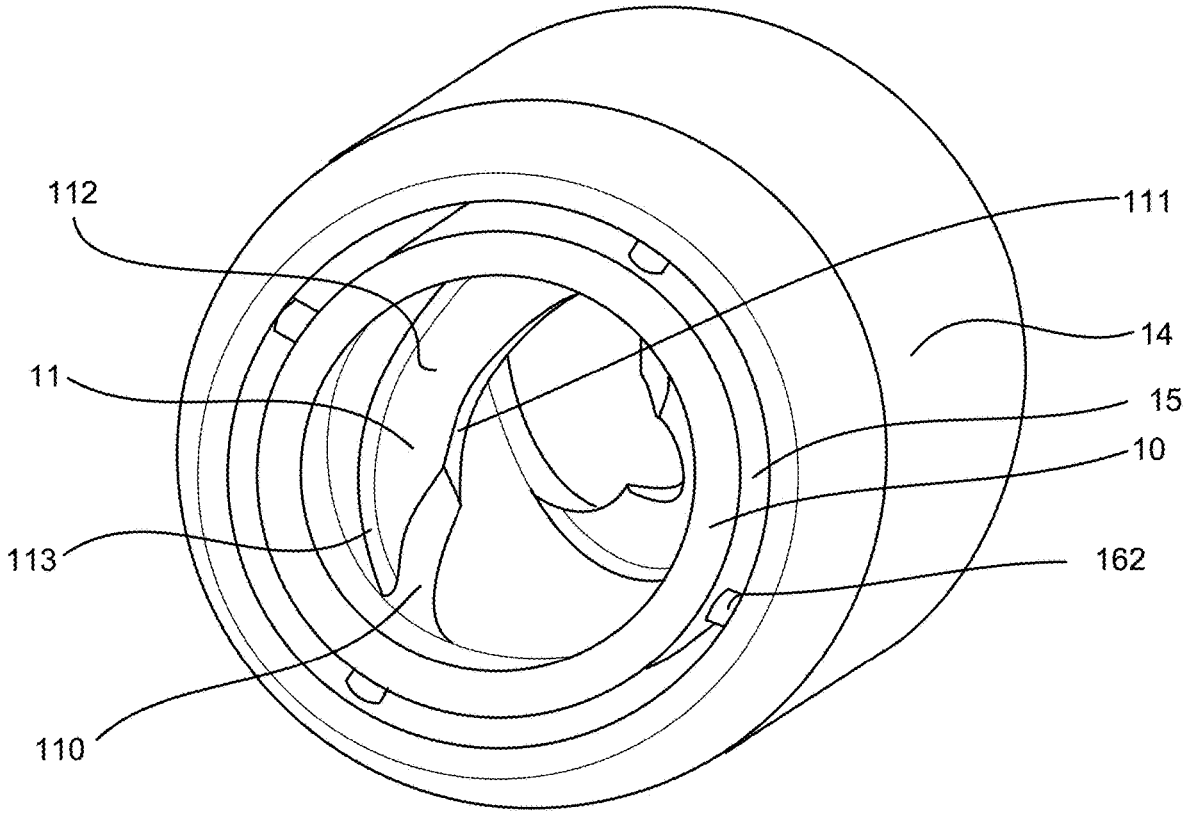
FIG. 15 is a perspective schematic view of the heat transfer enhancement pipe according to a preferred embodiment of the present invention, wherein a heat insulator is provided at the outside of the pipe body, the fin has a trapezoidal cross section, the transition angle is 30°.
Figure 16:
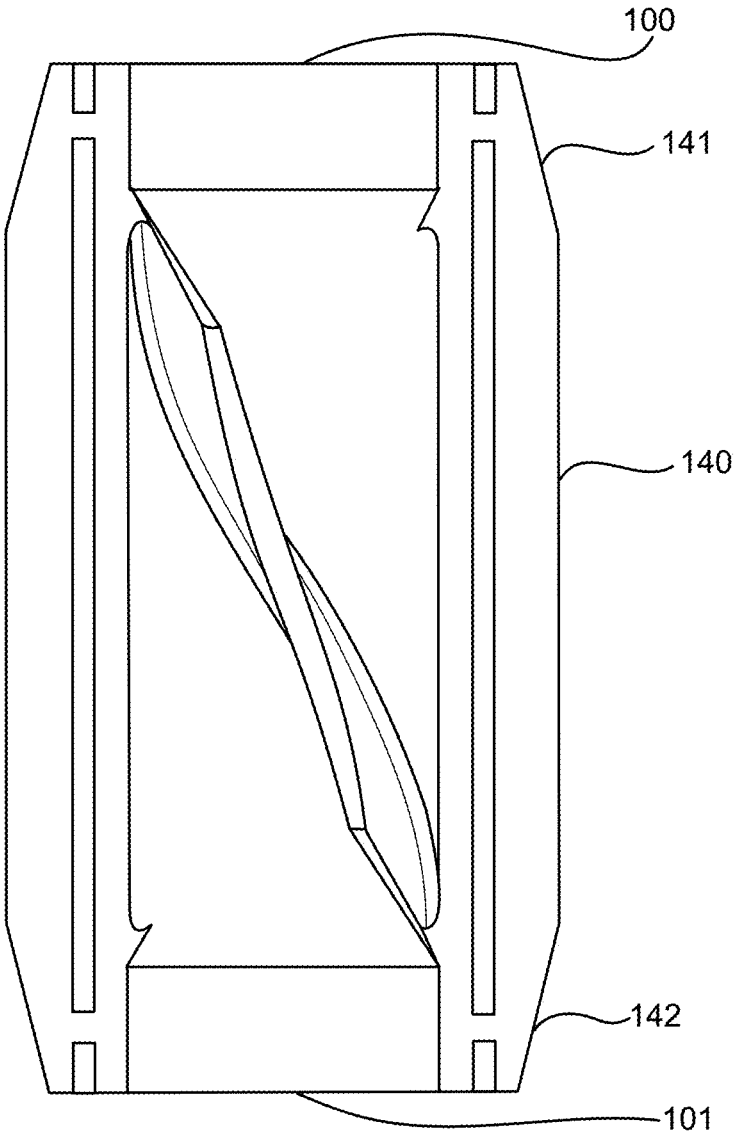
FIG. 16 is a cross-sectional structural schematic view of the heat transfer enhancement pipe shown in FIG. 15.
Figure 17:
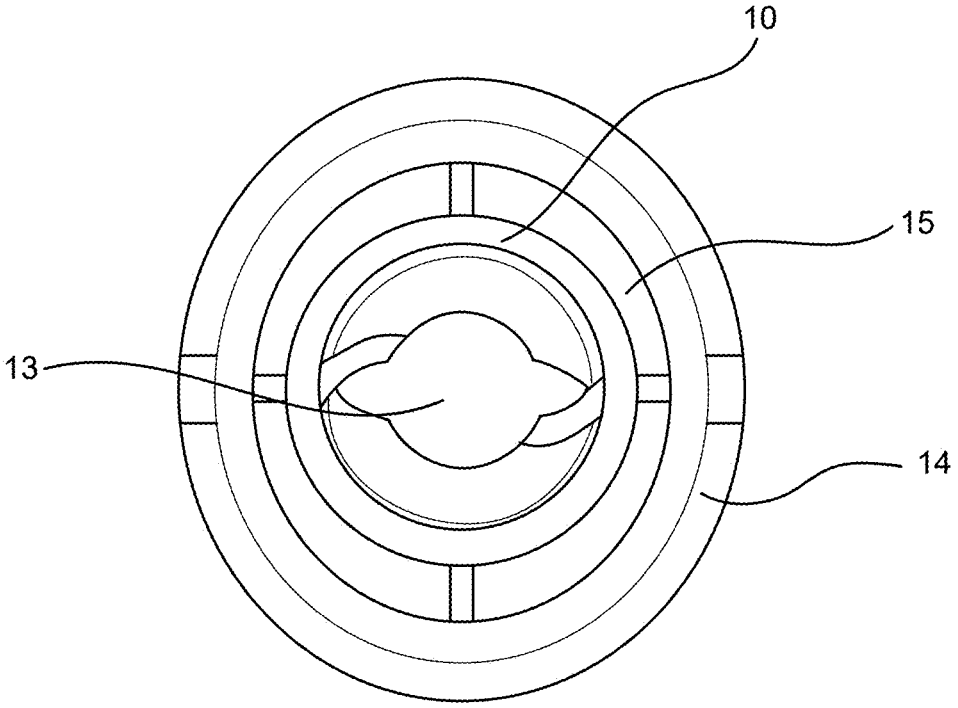
FIG. 17 is a perspective schematic view of the heat transfer enhancement pipe according to another preferred embodiment of the present invention, wherein a heat insulator is provided at the outside of the pipe body, the fin has a trapezoidal cross section, the transition angle is 35°.

As shown in FIGS. 15-26, heat insulator 14 can be tubular and is preferably sleeved on the outside of the pipe body 10, so as to further reduce temperature of the pipe wall of the pipe body 10, thereby further reducing heat stress of the heat transfer enhancement pipe 1. As for the shape and structure of the heat insulator 14, they are not specifically limited: as shown in FIG. 15, heat insulator 14 can be cylindrical; or as shown in FIG. 17, heat insulator 14 can be elliptical.

Figure 19:
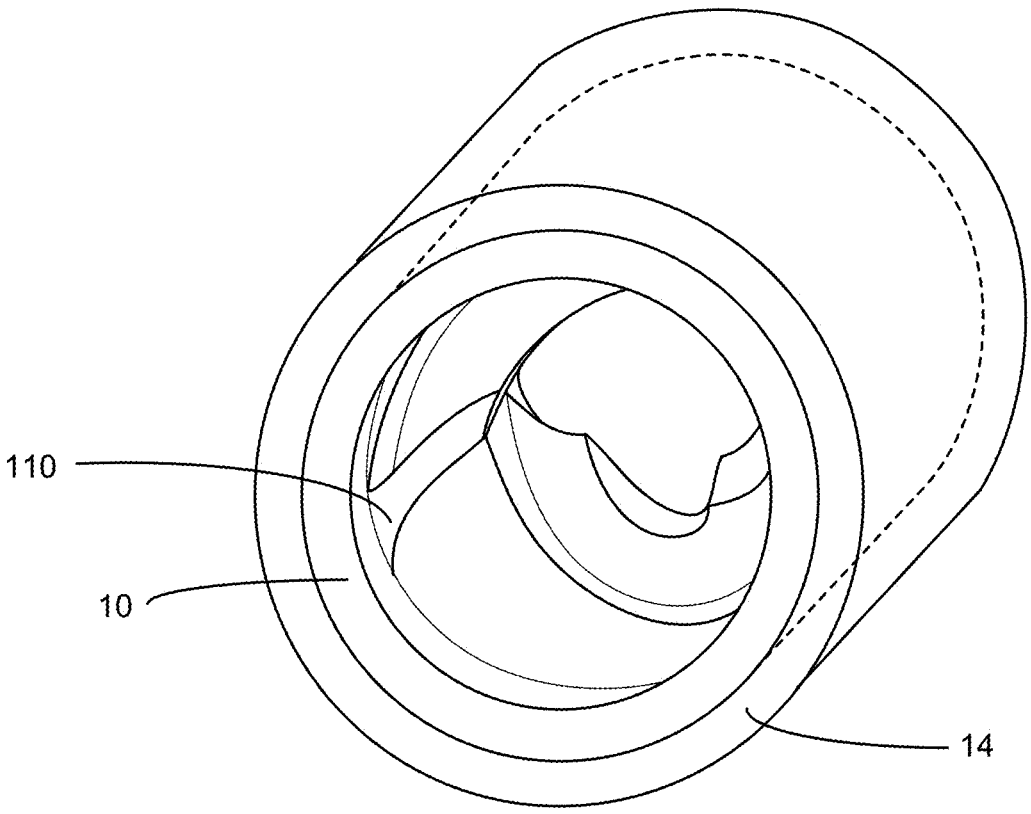
FIG. 19 is a perspective schematic view of a heat transfer enhancement pipe according to another preferred embodiment of the present invention, wherein a heat insulator is provided at the outside of the pipe body, the fin has a trapezoidal cross section, the transition angle is 40°.
Figure 20:
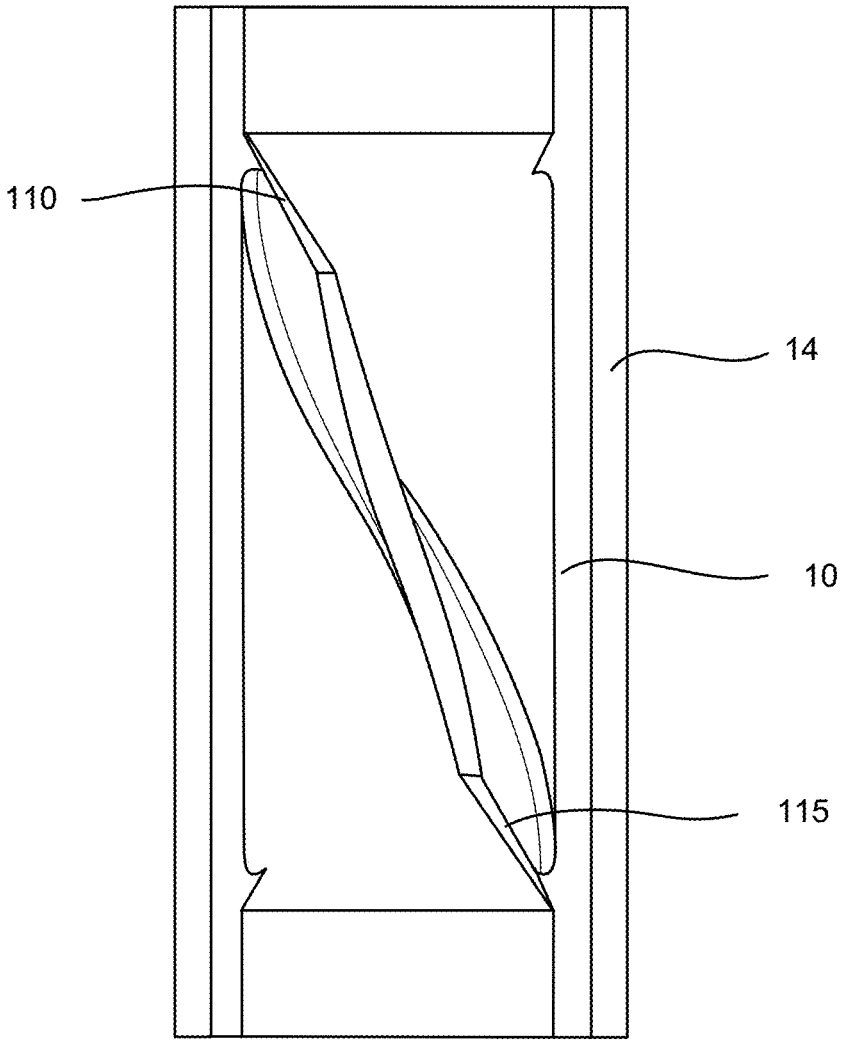
FIG. 20 is a cross-sectional structural schematic view of the heat transfer enhancement pipe shown in FIG. 19.
Figure 22:
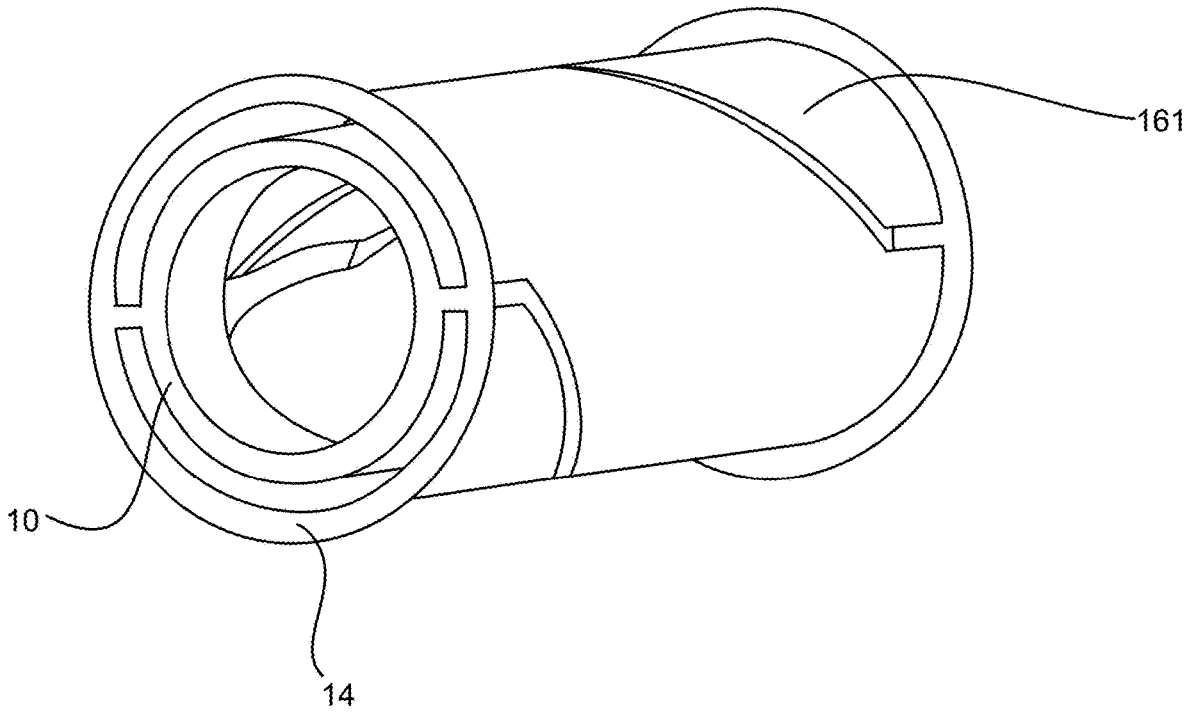
FIG. 22 is a perspective schematic view from another angle of the heat transfer enhancement pipe shown in FIG. 21.
Figure 23:
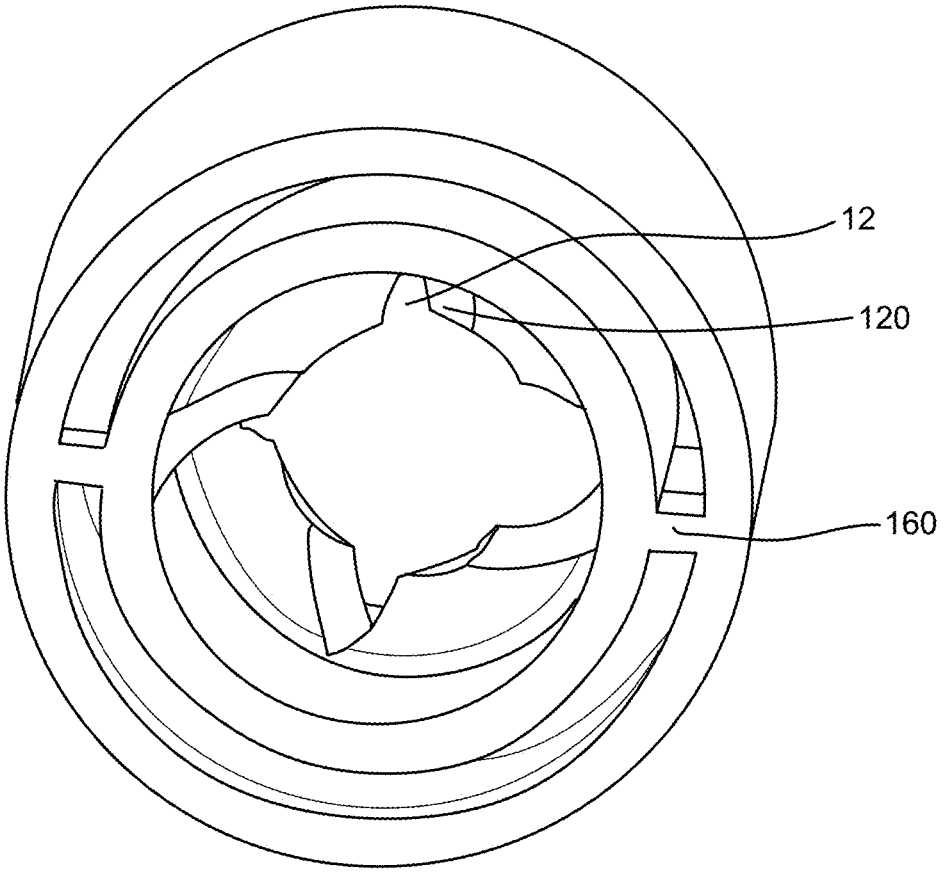
FIG. 23 is a perspective schematic view of the heat transfer enhancement pipe according to another preferred embodiment of the present invention, wherein a heat insulator is provided at the outside of the pipe body, the fin has a trapezoidal cross section, the number of intervals arranged at the fin is 1, the transition angle is 35°.
Figure 24:
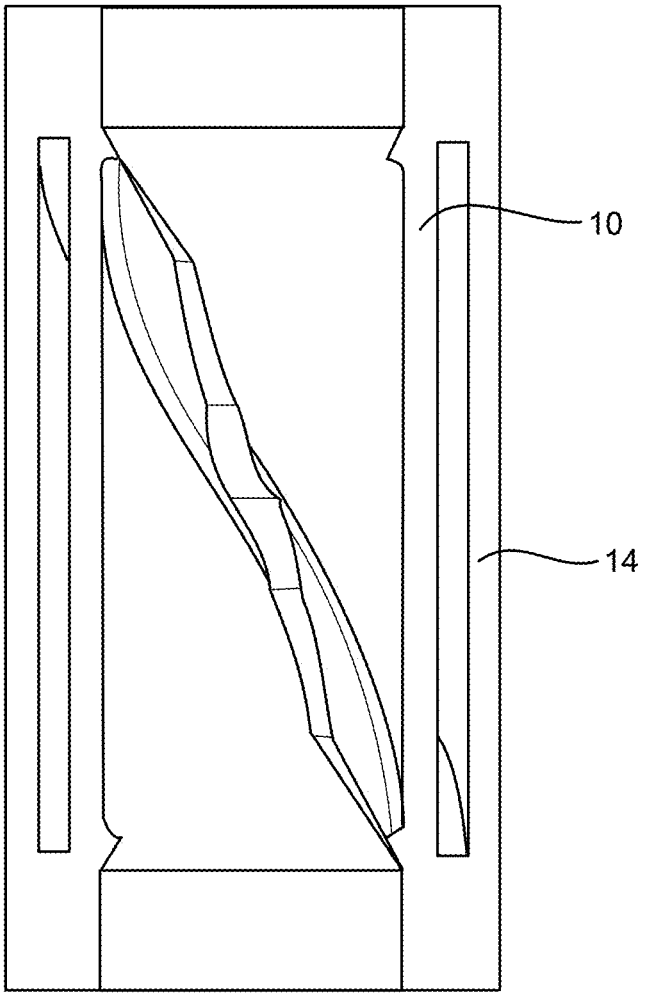
FIG. 24 is a cross-sectional structural schematic view of the heat transfer enhancement pipe shown in FIG. 23.
Figure 25:
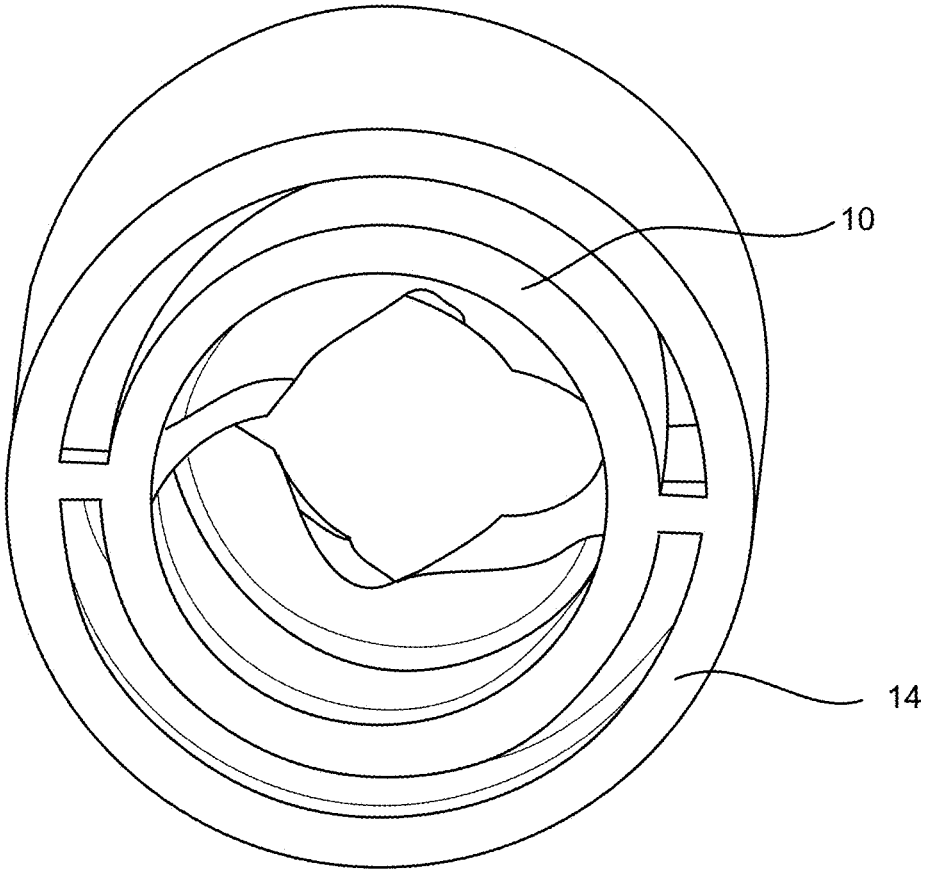
FIG. 25 is a perspective schematic view of the heat transfer enhancement pipe according to another preferred embodiment of the present invention, wherein a heat insulator is provided at the outside of the pipe body, the fin has a trapezoidal cross section, the transition angle is 35°, and the top surface of the fin facing the central axis of the pipe body is formed as the third transition surface of concave shape.
Figure 26:
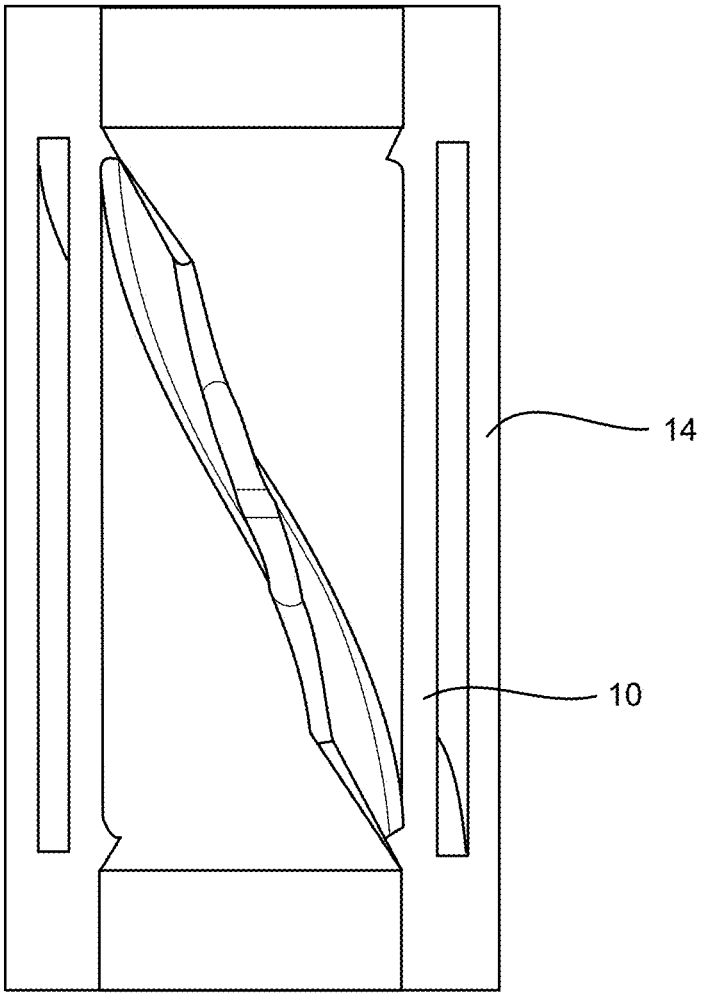
FIG. 26 is a cross-sectional structural schematic view of the heat transfer enhancement pipe shown in FIG. 25.
Figure 27:
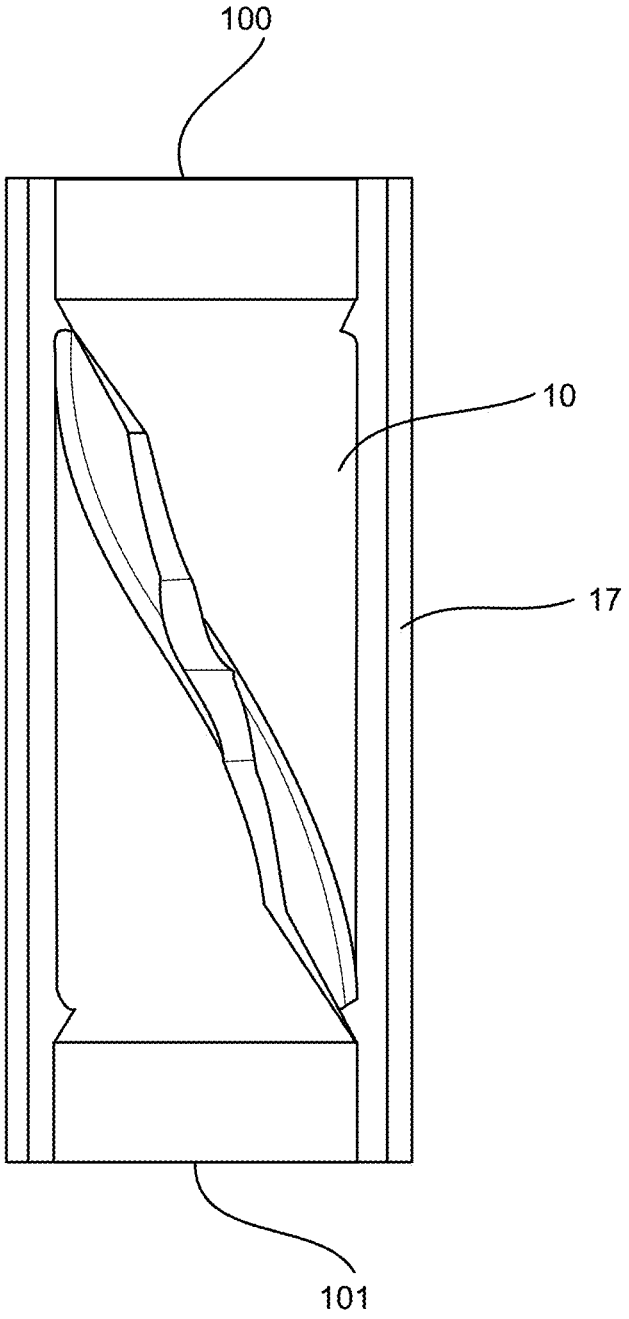
FIG. 27 is a cross-sectional structural schematic view of the heat transfer enhancement pipe according to a preferred embodiment of the present invention, wherein a heat insulating layer is provided on the external surface of the pipe body, the fin has a trapezoidal cross section, the number of intervals arranged at the fin is 1, the transition angle is 35°.
Figure 28:
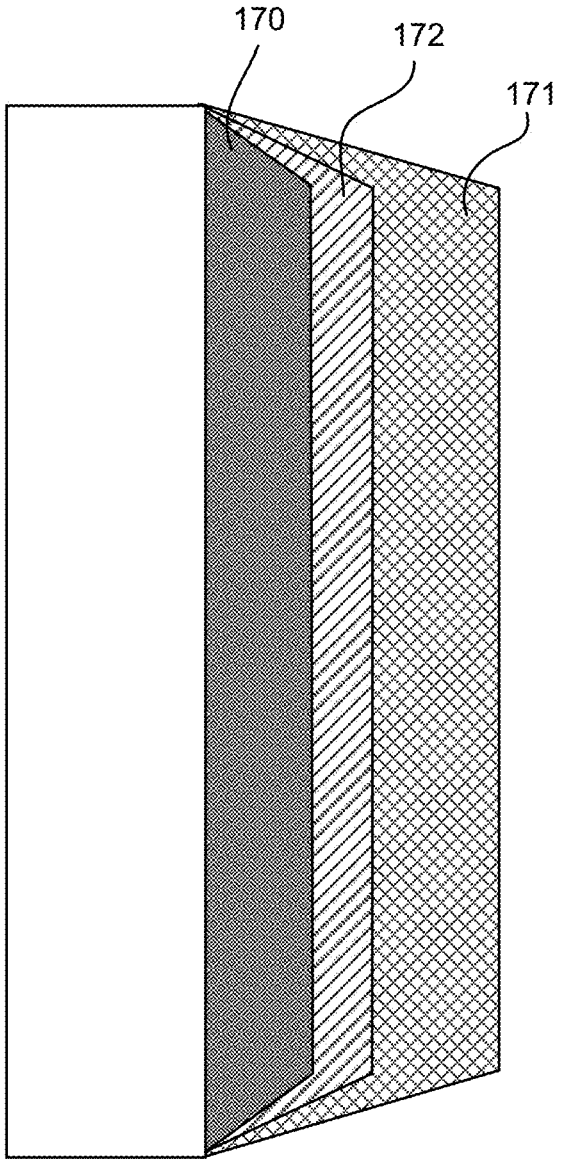
FIG. 28 is a local structural schematic view of the heat transfer enhancement pipe shown in FIG. 27, wherein a heat insulating layer is provided on the external surface of the pipe body, which includes a metal alloy layer, an oxide layer, and a ceramic layer sequentially stacked at the external surface of the pipe body.

In addition, the manner in which the heat insulator 14 is disposed is also not specifically limited, as shown in FIG. 19 and FIG. 20, the heat insulator 14 can abut on the external surface of the pipe body 10; as shown in FIG. 22 and FIG. 23, heat insulator 14 can also be sleeved on the outside of the pipe body 10; and gap 15 can be left between heat insulator 14 and the external wall of the pipe body 10. By leaving gap 15 between heat insulator 14 and the external wall of the pipe body 10, temperature of the pipe wall of the pipe body 10 in use is further reduced, thereby further reducing thermal stress of the heat transfer enhancement pipe 1.

Figure 21:
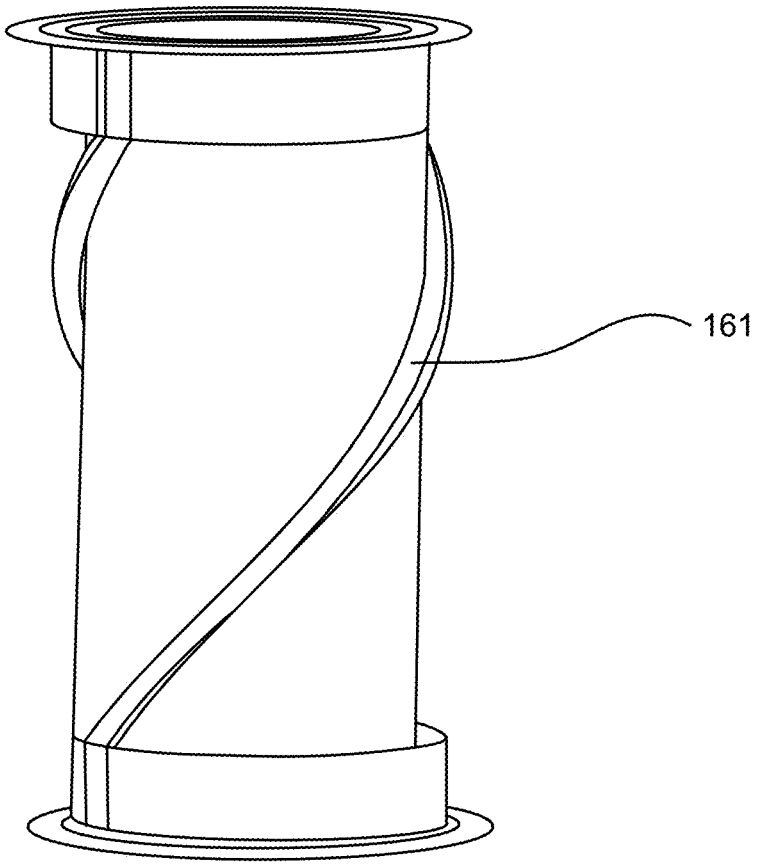
FIG. 21 is a perspective schematic view of a heat transfer enhancement pipe according to another preferred embodiment of the present invention, wherein the connecting part supported between the pipe body and the heat insulator is the second connecting part.

In order to further improve structural stability of the heat transfer enhancement pipe 1, a connector that connects heat insulator 14 and pipe body 10 can be arranged therebetween, wherein the structural form of the connector is not specifically limited as long as it can connect heat insulator 14 with pipe body 10. As shown in FIG. 23, the connector can include a first connecting piece 160 that can extend in an axial direction parallel to pipe body 10; as shown in FIG. 21, the connector can include a second connecting piece 161 that can extend spirally along the external wall of the pipe body 10; as shown in FIG. 15 and FIG. 17, the connector can include a connecting rod 162 with both ends thereof connectable to the external wall of the pipe body 10 and the internal wall of the heat insulator 14, respectively. It is also to be understood that any two or more of the connectors of the above three structures can be optionally arranged between heat insulator 14 and pipe body 10. Preferably, the connector is prepared and obtained from hard materials such as 35Cr45Ni or from soft materials such as ceramic fiber.

Figure 18:
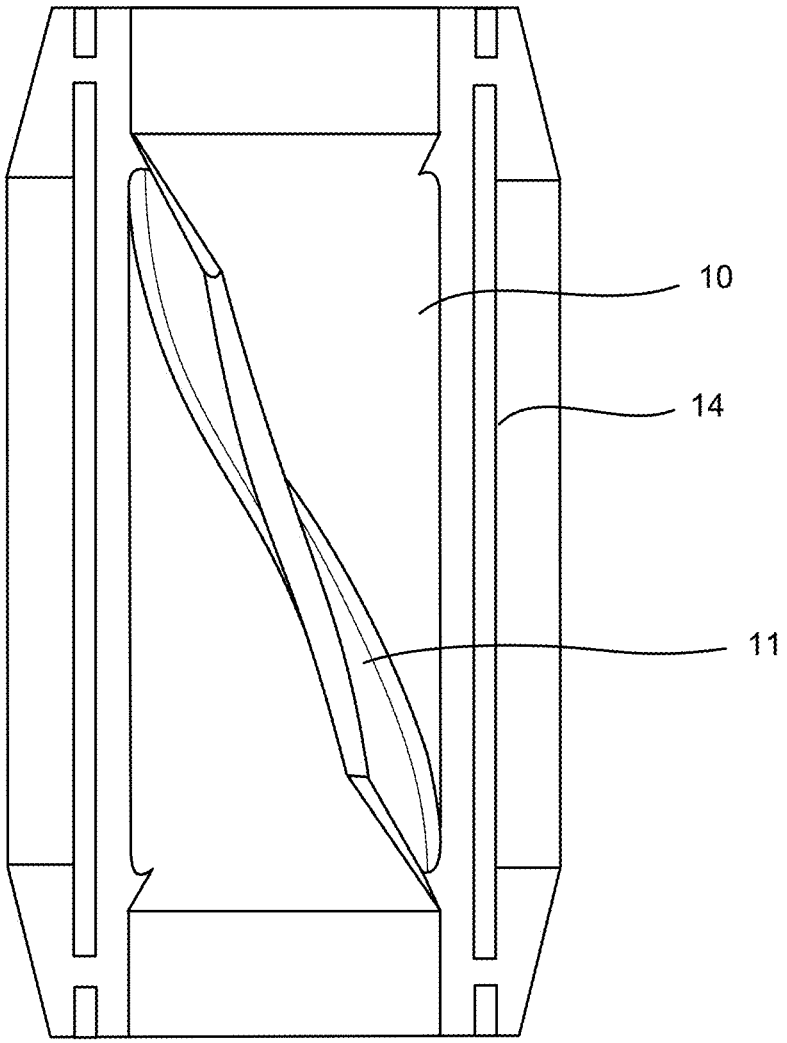
FIG. 18 is a cross-sectional structural schematic view of the heat transfer enhancement pipe shown in FIG. 17.

As shown in FIGS. 15, 16, and 18, heat insulator 14 can include a straight pipe section 140, and a first tapered pipe section 141 and a second tapered pipe section 142 that are connected to the first end and the second end of straight pipe section 140, respectively, wherein the first tapered pipe section 141 is tapered in a direction from close to the first end to away from the first end; the second tapered pipe section 142 is tapered in a direction from close to the second end to away from the second end. Heat insulator 14 is arranged as the above structure, so that not only temperature of the pipe wall of the pipe body 10 is effectively decreased, but also temperature variation in the axial direction of the pipe body 10 is relatively uniform, while thermal stress of the heat transfer enhancement pipe 1 is also reduced.

Further, the angle formed between the horizontal surface and the external wall surface of the first tapered pipe section 141 is preferably 10-80°; specifically, the angle formed between the horizontal surface and the external wall surface of the first tapered pipe section 141 can be 20°, 30°, 40°, 50°, 60°, or 70°. The angle formed between the horizontal surface and the external wall surface of the second tapered pipe section 142 is preferably 10-80°; similarly, the angle formed between the horizontal surface and the external wall surface of the second tapered pipe section 142 can be 20°, 30°, 40°, 50°, 60°, or 70°.

Further, the extension length of the heat insulator 14 in the axial direction of the pipe body 10 is preferably 1-2 times the length of the pipe body 10. Setting the axial length of the heat insulator 14 within the above range can further decrease temperature of the pipe wall of the pipe body 10 in use and further reduces thermal stress of the pipe body 10.

Effects of the present invention will be further illustrated through examples and comparative Examples in the following.

EXAMPLE31

Example 31 is the same as Example 11, except that: a heat insulator 14 of cylindrical shape is arranged on the outside of the pipe body 10; heat insulator 14 completely surrounds the external circumference of the pipe body 10 and leaves gap 15 with the external wall of the pipe body; heat insulator 14 is connected with pipe body 10 through connecting rod 162; the cross section of each fin 11, i.e. the cross section taken from a surface in the radial direction parallel to pipe body 10, is substantially trapezoidal; the angle formed by each side wall face 112 and the internal wall of the pipe body 10 is 45°.

EXAMPLE 32

Example 32 is the same as Example 31 except that: heat insulator 14 is elliptical; the transition angle of the first transition surface is 35°; the transition angle of the second transition surface is 35°. Other conditions remain unchanged.

EXAMPLE 33

Example 33 is the same as Example 31 except that: heat insulator 14 is attached to the external wall of the pipe body 10; the transition angle of the first transition surface is 40°; the transition angle of the second transition surface is 40°. Other conditions remain unchanged.

COMPARATIVE EXAMPLE 31

Comparative Example 31 is the same as Comparative Example 11, that is, a heat transfer enhancement pipe of the prior art is arranged, wherein the outside of the pipe body is not provided with a heat insulator; the interior of the pipe body is provided with only one fin 11 that extends spirally in the axial direction of the pipe body and separates the interior of the pipe body into two mutually non-communicating chambers, with the remaining conditions unchanged.

Respective test results of the cracking furnaces in the examples and the comparative Example after operating under same conditions are shown in Table 3 below.

TABLE 3

| | Test items | | | |
|---|---|---|---|---|
| No. | Heat transfer load/W | Pressure drop/MPa | Maximum thermal stress/MPA | Service life/year |
| Example 31 | 94620 | 0.10835 | 40 | 6-7 |
| Example 32 | 94620 | 0.10835 | 30 | 7-8 |
| Example 33 | 95650 | 0.10835 | 30 | 7-8 |
| Comparative Example 31 | 89889 | 0.12085 | 110 | 4-5 |

It can be known from the above that providing the heat transfer enhancement pipe provided by the invention in the cracking furnace increases heat transfer load, significantly increases heat transfer efficiency, and significantly reduces pressure drop, while reducing maximum thermal stress of the heat transfer enhancement pipe and significantly increasing service life of the heat transfer enhancement pipe.

According to another example of the present invention, a heat insulating layer 17 is provided on the external surface of the pipe body 10. By providing the heat insulating layer 17 on the external surface of the pipe body 10, heat transfer between high-temperature gas and the pipe wall of the pipe body 10 is impeded to reduce temperature of the pipe wall of the pipe body 10, thereby reducing temperature difference between the pipe body 10 and the fin 11, so as to effectively reduce thermal stress of the heat transfer enhancement pipe 1, extend service life of the heat transfer enhancement pipe 1, and also improve high temperature resistance performance, thermal shock performance, and high-temperature corrosion resistance performance of the heat transfer enhancement pipe 1 because of the arrangement of the heat insulating layer 17. When applying the aforementioned heat transfer enhancement pipe 1 to a cracking furnace, long-term stable operation of the cracking furnace can be ensured. Since the fins are arranged in pipe body 10, the fluid entering into pipe body 10 can turn into a swirling flow; due to its tangential velocity, the fluid can destroy the boundary layer and reduces the rate of coking. In addition, heat insulating layer 17 can preferably be arranged at the outside of the pipe body 10 that is provided with the fins, so that the fins are not easily cracked away from pipe body 10, and thermal stress of the heat transfer enhancement pipe 1 can be reduced.

Preferably, heat insulating layer 17 can include a metal alloy layer 170 arranged on the external surface of the pipe body 10 and a ceramic layer 171 arranged on the metal alloy layer 170. Through providing metal alloy layer 170 on the external surface of the pipe body 10 and ceramic layer 171 on the metal alloy layer 170, the heat insulating effect of the heat insulating layer 17 can be improved to further decrease thermal stress of the heat transfer enhancement pipe 1.

It is to be understood that metal alloy layer 170 can be prepared and formed by metal alloy materials including M, Cr, Al, and Y, wherein M is selected from one or more of Fe, Ni, Co, and Al; when M is selected from two or more metals therein, such as Ni and Co, metal alloy layer 170 can be prepared and formed by metal alloy materials including Ni, Co, Cr, Al, and Y; when metal alloy layer 170 contains Ni and Co, heat insulating ability of the heat insulating layer 17 can be further improved, and oxidation resistance and hot corrosion resistance of the heat insulating layer 17 are improved. As for the content of each metal in the metal alloy materials, it can be configured according to actual needs with no particular requirement. For example, the weight fraction of Al can be 5-12%, and the weight fraction of Y can be 0.5-0.8%, so that the robustness of the heat insulating layer 17 can be improved, while reducing oxidation rate of metal alloy layer 170; the weight fraction of Cr can be 25-35%. In addition, it should also be noted that the metal alloy materials can be sprayed on the external surface of the pipe body 10 to form metal alloy layer 170 by employing low pressure plasma, atmospheric plasma, or electron-beam physical vapor deposition. Thickness of metal alloy layer 170 can be 50 to 100 μm; specifically, thickness of metal alloy layer 170 can be 60 μm, 70 μm, 80 μm, or 90 μm.

In order to further improve oxidation resistance of the heat insulating layer 17 and extend service life of the heat insulating layer 17, additive materials can be added to the metal alloy materials for preparing metal alloy layer 170, that is, metal alloy layer 170 can be prepared and formed after mixing the metal alloy materials with the additive materials, wherein the metal alloy materials include M, Cr, Al, and Y, wherein M is selected from one or more of Fe, Ni, Co, and Al; the additive materials are selected from Si, Ti, Co, or $Al_2O_3$; as for the amount of addition of the additive materials, it can be added according to actual needs with no particular limitations, wherein the metal alloy materials have already been described in the above, and will not be described in details herein again.

In addition, ceramic layer 171 can be prepared and formed by one or more materials from yttria-stabilized zirconia, magnesia-stabilized zirconia, calcia-stabilized zirconia, and ceria-stabilized zirconia. When ceramic layer 171 is formed by two or more materials from the above, any two or more of the above materials can be mixed and then form into ceramic layer 171 after mixing. Specifically, when selecting yttria-stabilized zirconia as the material for ceramic layer 171, ceramic layer 171 can have a relatively high thermal expansion system, for example, it can reach up to $11\times10^{-6}$ $K^{-1}$; ceramic layer 171 can also have a relatively low thermal conductivity coefficient of 2.0-2.1 $Wm^{-1}K^{-1}$; while ceramic layer 171 also has good thermal shock resistance. It should also be noted that when selecting yttria-stabilized zirconia as ceramic layer 171, the weight fraction of yttrium oxide is 6-8%. In order to further improve heat insulating performance of the heat insulating layer 17, cerium oxide can also be added to the above materials forming ceramic layer 171; specifically, the amount of addition of cerium oxide can be 20-30% of the total weight of yttria-stabilized zirconia; further, the amount of addition of cerium oxide can be 25% of the total weight of yttria-stabilized zirconia. Similarly, one or more materials of yttria-stabilized zirconia, magnesia-stabilized zirconia, calcia-stabilized zirconia, and ceria-stabilized zirconia can be sprayed onto the external surface of metal alloy surface 170 to form ceramic layer 171 by employing methods of low pressure plasma, atmospheric plasma, or electron-beam physical vapor deposition. In addition, the thickness of ceramic layer 171 can be 200-300 μm; for example, the thickness of ceramic layer 171 can be 210 μm, 220 μm, 230 μm, 240 μm, 250 μm, 260 μm, 270 μm, 280 μm, or 290 μm. It should be noted that when the heat transfer enhancement pipe 1 is in use, the Al in metal alloy layer 170 reacts with the oxygen in ceramic layer 171 to form a thin and dense aluminum-oxide protective film, thereby protecting pipe body 10.

In order to improve peeling resistance of the heat insulating layer 17, an oxide layer 172 can be arranged between metal alloy layer 170 and ceramic layer 171, wherein oxide layer 172 is preferably prepared and formed by alumina, silica, titania, or a mixture of any two or more materials from alumina, silica, and titania. Preferably, alumina is selected for preparing and forming oxide layer 172 to improve heat insulating performance of the heat insulating layer 17. Similarly, the above oxide materials can be sprayed onto the surface of metal alloy layer 170 to form oxide layer 172 by employing methods of low pressure plasma, atmospheric plasma, or electron-beam physical vapor deposition. In addition, the thickness of oxide layer 172 can be 3-5 μm; for example, the thickness of oxide layer 172 can be 4 μm.

Additionally, the porosity of the heat insulating layer 17 can be 8 to 15%.

In order to effectively reduce temperature of the pipe wall of the pipe body 10 and to make temperature variation in the axial direction of the pipe body 10 relatively uniform while also to reduce thermal stress of the heat transfer enhancement pipe 1, heat insulation layer 17 can include a straight section, and a first tapered section and a second tapered section that are connected to the first end and the second end of the straight section, respectively, wherein the first tapered section is tapered in a direction from close to the first end to away from the first end; the second tapered section is tapered in a direction from close to the second end to away from the second end. It is to be understood that the thickness of the heat insulating layer 17 is thinner near the ends; the thickness of the heat insulating layer 17 can gradually decrease by a value of 5-10%. In order to further reduce thermal stress of the heat transfer enhancement pipe 1, heat insulating layer 17 is thicker at positions corresponding to the fins.

Effects of the present invention will be further illustrated through Examples and comparative Examples in the following.

EXAMPLE 41

Example 41 is the same as Example 11, except that: the heat insulating layer 17 is disposed on the external surface of the pipe body 10, the heat insulating layer 17 includes a 70 μm thick metal alloy layer 170, a 4 μm thick oxide layer 172, and a 240 μm thick ceramic layer 171 sequentially arranged at the external surface of the pipe body 10; wherein the metal alloy layer 170 is spray-formed from metal alloy materials having weight fraction of 64.5% Ni, 30% Cr, 5% Al, and 0.5% Y via atmospheric plasma spray method; the oxide layer 172 is formed by spraying aluminum oxide to the surface of metal alloy layer 170 by a selected method of low pressure plasma spray; the ceramic layer 171 is formed by spraying yttria-stabilized zirconia mixed with cerium oxide of 25% weight fraction of the yttria-stabilized zirconia; in the yttria-stabilized zirconia, the weight fraction of cerium oxide is 6%, the transition angle of the first transition surface is 35°; the transition angle of the second transition surface is 35°; the cross section of each fin 11, i.e. the cross section taken from a surface in the radial direction parallel to pipe body 10, is substantially trapezoidal; the angle formed by each side wall face 112 and the internal wall of the pipe body 10 is 45°.

EXAMPLE 42

Example 42 is the same as Example 41, except that: in heat insulating layer 17, metal alloy layer 170 is prepared and formed by metal alloy materials having weight fraction of 64.2% Ni, 30% Cr, 5% Al, and 0.8% Y, respectively; ceramic layer 171 is formed by yttria-stabilized zirconia; in the yttria-stabilized zirconia, the weight fraction of yttrium oxide is 8%. Other conditions remain unchanged.

COMPARATIVE EXAMPLE 41

Comparative Example 41 is the same as Comparative Example 11, i.e.: the heat transfer enhancement pipe of the prior art is arranged (the external surface of the pipe body is not provided with heat insulating layer), wherein the outside of the pipe body is not provided with heat insulating layer; the interior of the pipe body is provided with only one fin that extends spirally in the axial direction of the pipe body and separates the interior of the pipe body into two mutually non-communicating chambers, with the remaining conditions unchanged.

Respective test results of the cracking furnaces in the Examples and the comparative Example after operating under same conditions are shown in Table 4 below.

TABLE 4

| | Test items | | | | |
|---|---|---|---|---|---|
| No. | Heat transfer load/W | Pressure drop/MPa | Temperature difference between the fin and the pipe wall of the pipe body/° C. | Maximum thermal stress/MPA | Service life/year |
| Example 41 | 94700 | 0.10780 | 20-25 | 40 | 6-7 |
| Example 42 | 94620 | 0.10820 | 20-25 | 40 | 6-7 |
| Comparative Example 41 | 88080 | 0.12090 | 35-40 | 110 | 4-5 |

It can be known from the above that providing the heat transfer enhancement pipe provided by the invention in the cracking furnace increases heat transfer load, significantly increases heat transfer efficiency, and significantly reduces pressure drop, while reducing maximum thermal stress of the heat transfer enhancement pipe and significantly increasing service life of the heat transfer enhancement pipe.

Preferred embodiments of the present invention have been described in detail above in association with the drawings; however, the present invention is not limited thereto. Various simple alterations of the technology of the present invention including combinations of each specific technological feature in any suitable ways can be made in the scope of the technology contemplated in the present invention. To avoid unnecessary repetitions, the present invention will not illustrate further on various possible combinations. However, these simple alterations and combinations should be regarded as contents disclosed by the present invention and fall into the scope protected by the present invention.

The invention claimed is:

1. A heat transfer enhancement pipe comprising:

a pipe body of a tubular shape having an inlet for entering of a fluid and an outlet for the fluid to flow out;

wherein:

an internal wall of the pipe body is welded at a welding site with a fin protruding towards interior of the pipe body, the fin comprising two opposite side wall faces spirally extending in an axial direction of the pipe body, and a height of the fin gradually increases from one end for at least a partial extension of the fin, wherein the fin comprises an end surface facing the inlet or the outlet, the end surface being a curved surface and configured to reduce thermal stress at the welding site during operation, wherein the curved surface has a concave or a convex shape.

2. The heat transfer enhancement pipe according to claim 1, wherein the height of the fin gradually increases from an end of the fin close to the inlet.

3. The heat transfer enhancement pipe according to claim 1, wherein the height of the fin gradually increases from an end of the fin close to the outlet.

4. The heat transfer enhancement pipe according to claim 1, wherein the height of the fin gradually increases from both ends of the fin to the middle of the fin.

5. The heat transfer enhancement pipe according to claim 1, wherein the height of the fin gradually increases from an end of the fin close to the inlet to the middle of the fin for a partial extension of the fin close to the inlet and/or from an end of the fin close to the outlet to the middle of the fin for a partial extension of the fin close to the outlet, and in other parts of the fin, the height of the fin varies wavily.

6. The heat transfer enhancement pipe according to claim 1, wherein a first end surface of the fin closest to the inlet is formed as a first transition surface; and/or a second end surface of the fin closest to the outlet is formed as a second transition surface.

7. The heat transfer enhancement pipe according to claim 1 wherein a heat insulator at least partially surrounds an external circumference of the pipe body.

8. The heat transfer enhancement pipe according to claim 7, wherein the heat insulator has a tubular shape and is configured to be sleeved on the outside of the pipe body.

9. The heat transfer enhancement pipe according to claim 8, wherein a gap is left between the heat insulator and an external wall of the pipe body.

10. The heat transfer enhancement pipe according to claim 9, wherein a connector for connecting the heat insulator and the pipe body is arranged between the heat insulator and the pipe body.

11. The heat transfer enhancement pipe according to claim 10, wherein the connector comprises one or more of the following structures:

a first connecting piece that extends in an axial direction parallel to the pipe body;

a second connecting piece that extends spirally along the external wall of the pipe body; and a connecting rod with its two ends respectively connected to the external wall of the pipe body and an internal wall of the heat insulator.

12. The heat transfer enhancement pipe according to claim 8, wherein the heat insulator comprises:

a straight pipe section having a first end and a second end;

a first tapered pipe section; and a second tapered pipe section, the first tapered pipe section and the second tapered pipe section configured to be respectively connected to the first end and second end of the straight pipe section;

wherein the first tapered pipe section is tapered in a direction from close to the first end to away from the first end; and the second tapered pipe section is tapered in a direction from close to the second end to away from the second end.

13. The heat transfer enhancement pipe according to claim 1 wherein a heat insulating layer is provided on an external surface of the pipe body.

14. The heat transfer enhancement pipe according to claim 13, wherein the heat insulating layer comprises a metal alloy layer outside of the external surface of the pipe body and a ceramic layer outside of the metal alloy layer.

15. The heat transfer enhancement pipe according to claim 14, wherein the heat insulating layer comprises an oxide layer between the metal alloy layer and the ceramic layer; and the oxide layer is prepared and formed by alumina, silica, titania, or a mixture of any two or more materials selected from alumina, silica, and titania.

16. The heat transfer enhancement pipe according to claim 14, wherein the metal alloy layer is prepared and formed by metal alloy materials including M, Cr, Al, and Y, wherein M is selected from one or more of Fe, Ni, Co, and Al.

17. The heat transfer enhancement pipe according to claim 16, wherein the metal alloy layer further comprises one or more additive materials selected from Si, Ti, Co, and $Al_2O_3$.

18. The heat transfer enhancement pipe according to claim 14, wherein the ceramic layer is prepared and formed by one or more materials selected from yttria-stabilized zirconia, magnesia-stabilized zirconia, calcia-stabilized zirconia, and ceria-stabilized zirconia.

19. The heat transfer enhancement pipe according to claim 13, wherein the heat insulating layer comprises:

a straight section having a first end and a second end;

a first tapered section; and a second tapered section; the first tapered section and the second tapered section configured to be respectively connected to the first end and second end of the straight section, wherein the first tapered section is tapered in a direction from close to the first end to away from the first end; and the second tapered section is tapered in a direction from close to the second end to away from the second end.

20. A cracking furnace or atmospheric and vacuum heating furnace, comprising:

a radiation chamber, in which at least one furnace pipe assembly is installed;

wherein the at least one furnace pipe assembly comprises a plurality of furnace pipes arranged in sequence and a heat transfer enhancement pipe communicating adjacent furnace pipes; and the heat transfer enhancement pipe is the heat transfer enhancement pipe according to claim 1.

* * * * *